US011081331B2

(12) United States Patent
Russell et al.

(10) Patent No.: US 11,081,331 B2
(45) Date of Patent: Aug. 3, 2021

(54) MASS SPECTROMETERS HAVING SEGMENTED ELECTRODES AND ASSOCIATED METHODS

(71) Applicant: Duke University, Durham, NC (US)

(72) Inventors: Zach Russell, Durham, NC (US); Michael Gehm, Durham, NC (US); Jeffrey T. Glass, Durham, NC (US); Shane Di Dona, Durham, NC (US); Evan Chen, Durham, NC (US); Charles Parker, Durham, NC (US); Jason Amsden, Durham, NC (US); David Brady, Durham, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 15/768,595

(22) PCT Filed: Oct. 28, 2016

(86) PCT No.: PCT/US2016/059496
§ 371 (c)(1),
(2) Date: Apr. 16, 2018

(87) PCT Pub. No.: WO2017/075470
PCT Pub. Date: May 4, 2017

(65) Prior Publication Data

US 2019/0057854 A1 Feb. 21, 2019

Related U.S. Application Data

(60) Provisional application No. 62/247,604, filed on Oct. 28, 2015.

(51) Int. Cl.
*H01J 49/32* (2006.01)

(52) U.S. Cl.
CPC ..... *H01J 49/322* (2013.01)

(58) Field of Classification Search
CPC ..... H01J 49/322; H01J 49/324; H01J 49/326
See application file for complete search history.

(56) References Cited

U.S. PATENT DOCUMENTS 3,527,938 A 9/1970 Delaney
3,622,781 A * 11/1971 Liebl ..... H01J 49/322 250/296

(Continued)

OTHER PUBLICATIONS

International Search Report and Written Opinion issued in PCT Application No. PCT/US2016/059496 dated Feb. 21, 2017, 8 pages.

(Continued)

*Primary Examiner* — Sean M Luck
(74) *Attorney, Agent, or Firm* — Olive Law Group, PLLC

(57) ABSTRACT

Disclosed herein are mass spectrometers having segmented electrodes and associated methods. According to an aspect, an apparatus or mass spectrometer includes an ion source configured to generate ions from a sample. The apparatus also includes a detector configured to detect a plurality of mass-to-charge ratios associated with the ions. Further, the apparatus includes segmented electrodes positioned between the ion source and the detector. The apparatus also includes a controller configured to selectively apply a voltage across the segmented electrodes for forming a predetermined electric field profile.

14 Claims, 34 Drawing Sheets

(56) References Cited

U.S. PATENT DOCUMENTS 3,745,343 A * 7/1973 Halliday ..... H01J 49/326 250/283
3,949,221 A 4/1976 Liebl
3,967,116 A * 6/1976 Geerk ..... H01J 49/30 250/298
4,524,275 A 6/1985 Cottrell et al.
4,638,160 A * 1/1987 Slodzian ..... H01J 49/326 250/296
4,672,204 A * 6/1987 Slodzian ..... H01J 49/326 250/294
4,912,326 A * 3/1990 Naito ..... H01J 49/32 250/296
4,945,236 A * 7/1990 Mogami ..... H01J 49/0004 250/281
4,952,803 A * 8/1990 Matsuda ..... H01J 49/32 250/296
5,118,939 A * 6/1992 Ishihara ..... H01J 49/322 250/296
5,194,732 A * 3/1993 Bateman ..... H01J 49/025 250/294
5,313,061 A * 5/1994 Drew ..... B01D 59/44 250/281
6,501,074 B1 * 12/2002 Gentry ..... H01J 49/328 250/281
6,614,021 B1 9/2003 Kalinitchenko
6,900,431 B2 5/2005 Belov et al.
6,989,533 B2 1/2006 Bellec et al.
7,399,957 B2 * 7/2008 Parker ..... H01J 49/0027 250/281
7,728,287 B2 * 6/2010 Felton ..... H01J 49/0004 250/281
7,858,934 B2 12/2010 Belford et al.
2006/0011829 A1 * 1/2006 Scheidemann .... G01N 30/7206 250/288
2008/0087814 A1 * 4/2008 Loucks ..... H01J 49/009 250/287
2008/0315086 A1 * 12/2008 Kovtoun ..... H01J 49/062 250/290
2009/0090853 A1 * 4/2009 Schoen ..... H01J 49/004 250/282
2009/0218486 A1 9/2009 Whitehouse et al.
2009/0242748 A1 10/2009 Li
2011/0192969 A1 * 8/2011 Verentchikov ..... H01J 49/062 250/282
2012/0286150 A1 * 11/2012 Muntean ..... H01J 49/062 250/282
2013/0168547 A1 7/2013 Nishiguchi et al.
2014/0117248 A1 5/2014 Kahen et al.
2014/0312219 A1 * 10/2014 Ardelt ..... H01J 49/322 250/282
2014/0353487 A1 * 12/2014 Giles ..... G01N 27/622 250/282

OTHER PUBLICATIONS

International Preliminary Report on Patentability and Written Opinion issued in PCT Application No. PCT/US2016/059496 dated May 1, 2018 (seven (7) pages).

* cited by examiner

Photorealistic Computer Render
of Stigmatic Electric Sector

Original Coded Aperture Pattern (S-101)

20mm Gap Electric Sector Pattern Transfer

Computationally Optimized
20mm Gap Electric Sector Pattern Transfer

Original Coded Aperture Pattern (S-101)

Electric Sector Pattern Transfer

MASS SPECTROMETERS HAVING SEGMENTED ELECTRODES AND ASSOCIATED METHODS

CROSS REFERENCE TO RELATED APPLICATION

This is a 371 national stage patent application, which claims priority to PCT International Patent Application No. PCT/US2016/059496, filed Oct. 28, 2016, and titled MASS SPECTROMETERS HAVING SEGMENTED ELECTRODES AND ASSOCIATED METHODS, which claims priority to U.S. Provisional Patent Application No. 62/247,604, filed Oct. 28, 2015, and titled MASS SPECTROMETERS HAVING SEGMENTED ELECTRODES AND ASSOCIATED METHODS; the disclosures of which are incorporated herein by reference in their entireties.

GOVERNMENT RIGHTS NOTICE

This invention was made with government support under grant number HSHQDC-11-C-00082, awarded by the Department of Homeland Security Science and Technology. The government has certain rights in the invention.

TECHNICAL FIELD

The present subject matter relates to mass spectrometry. More particularly, the present subject matter relates to mass spectrometers having segmented electrodes for improving transfer of higher order coded aperture patterns.

BACKGROUND

Mass spectrometers are commonly used in elemental analysis, offering quantitative sample anlaysis with the ability to resolve a broad range of atomic, molecular, and biological species. Spatially coded apertures analogous to those used optical spectroscopy have been applied to mass spectrometry, yielding gains in signal intensity of 10× and 4× for one-dimensional (1D) and two-dimensional (2D) coding techniques, respectively, using a simple 90-degree magnetic sector test setup with no corresponding losses in mass resolution. The increase in signal without loss in resolution breaks the throughput versus resolution tradeoff encountered in mass spectrometer miniaturization. In addition to increasing the performance of miniature instruments, aperture coding can improve the performance of laboratory instruments. Initial compatibility of simple codes with a miniature double-focusing Mattauch-Herzog mass spectrograph was demonstrated experimentally and with high fidelity particle tracing simulations and issues were identified with the electric sector that prevented use of more complex codes. Mattauch-Herzog mass analyzers can be found in a wide variety of instruments including fieldable mass spectrometers, inductively coupled plasma mass spectrometers, and secondary ion mass spectrometers.

While the Mattauch-Herzog mass spectrograph (MHMS) is double-focusing (focusing angle and energy) to first order for all masses, it does not perfectly focus ions emanating from points offset from the central beamline of its primary resolution-defining slit aperture. The traditional MHMS design is based on the paraxial approximation which assumes that ions travel close to the optical axis. However, spatially coded apertures extend the source of ions entering the spectrograph along a dimension perpendicular to the optical axis making the paraxial approximation used in many optical design tools (such as transfer matrix optics) insufficient for instruments using complex spatial codes.

In addition, high-order coded apertures are spatially expansive, requiring a wide electric sector gap to allow all ions to pass. As the electric sector gap increases, the electric field loses symmetry and becomes less uniform. There is a tradeoff between a wide gap that can allow a complex aperture but has a nonuniform field profile and a narrow gap with a uniform field profile that only allows a very simple aperture. Herzog shunts have been used to minimize the influence of sector faces on the electric field in areas near the electric sector. However, the ability of the Herzog shunts to limit the fringing field aberrations decreases with sector width. While the Herzog shunts keep the electric field from the external parts of the inner and outer electrodes contained, they do not effectively contain the electric field from the electric sector gap when the gap is large.

Despite the aforementioned improvements, there is still a desire to provide improved mass spectometers and techniques.

SUMMARY

Disclosed herein are mass spectrometers having segmented electrodes and associated methods. According to an aspect, an apparatus or mass spectrometer includes an ion source configured to generate ions from a sample. The apparatus also includes a detector configured to detect a plurality of mass-to-charge ratios associated with the ions. Further, the apparatus includes segmented electrodes positioned between the ion source and the detector. The apparatus also includes a controller configured to selectively apply a voltage across the segmented electrodes for forming a predetermined electric field profile.

BRIEF DESCRIPTION OF THE DRAWINGS

The foregoing aspects and other features of the present subject matter are explained in the following description, taken in connection with the accompanying drawings, wherein.

DETAILED DESCRIPTION

Figure 1A:
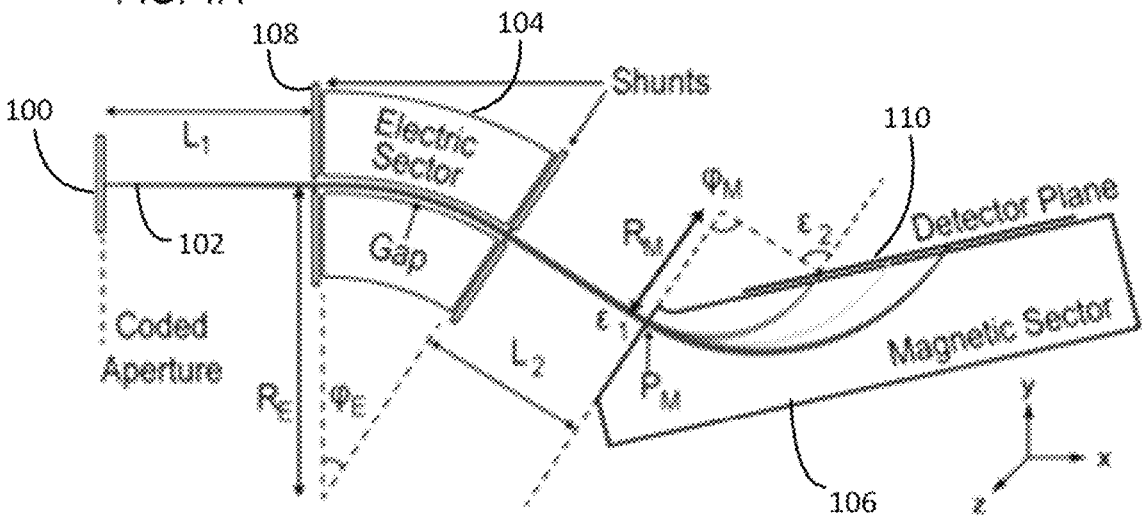
FIG. 1A is a schematic diagram of an example mass spectrograph in accordance with embodiments of the present disclosure.

For the purposes of promoting an understanding of the principles of the present disclosure, reference will now be made to various embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e. at least one) of the grammatical object of the article. By way of example, "an element" means at least one element and can include more than one element.

In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50.

Unless specifically stated or obvious from context, as used herein, the term "about" is understood as within a range of normal tolerance in the art, for example within 2 standard deviations of the mean. The term "about" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term "about."

Unless otherwise defined, all technical terms used herein have the same meaning as commonly understood by one of ordinary skill in the art to which this disclosure belongs.

As referred to herein, the term "mass spectrometer" or "mass spectrograph" refers to a device or equipment that utilizes an analytical chemistry technique that helps identify the amount and type of chemicals present in a sample by measuring the mass-to-charge ratio and abundance of gas-phase ions. A mass spectrum is a plot of the ion signal as a function of the mass-to-charge ratio. The spectra are used to determine the elemental or isotopic signature of a sample, the masses of particles and of molecules, and to elucidate the chemical structures of molecules. A mass spectrometer can separate and simultaneously focus ions, along a focal plane, of different mass/charge ratios that are diverging in direction and that have a variable velocity. With this equipment and a spatially sensitive ion detector simultaneous detection can be employed, which has been shown to improve precision and throughput.

As referred to herein, the term "mass spectrograph" is an instrument that separates and simultaneously focuses ions, along a focal plane, of different mass/charge ratios that are diverging in direction and that have a variable velocity. With these instruments and a spatially sensitive ion detector, simultaneous detection can be employed.

FIG. 1A illustrates a schematic diagram of an example mass spectrograph in accordance with embodiments of the present disclosure. Referring to FIG. 1A, the mass spectrograph includes an endcap electrode 100 defining a coded aperture through which ions 102 are introduced. The mass spectrograph also includes an electric sector 104 and a magnetic sector 106. The electric sector 104 is configured with shunts 108. The magnetic section is configured with a detector plane 110. The mass spectrograph separates charged particles by their mass-to-charge ratio. The magnetic sector 106 can disperse charged particles spatially according to their momentum, and the electric sector disperses charged particles according to their energy. These two components are linked in such a way as to cancel out the energy component of the magnets momentum dispersion leaving pure mass dispersion, which is measured on the detector plane 110. Shunts 108 can be used to limit the aberrant affects of fringing electric or magnetic fields.

The mass spectrograph shown in FIG. 1A is a Mattauch-Herzog mass spectrograph, although it should be understood that any suitable type of mass spectrograph may be used in accordance with embodiments of the present disclosure. Also, the presently disclosed subject matter may be suitably implemented with a mass spectrometer.

In accordance with embodiments, an electric sector is provided that breaks the tradeoff between wide and narrow sectors in Mattauch-Herzog mass spectrographs and enables stigmation of spatially coded apertures. The performance of this electric sector is compared to other electric sectors using finite element electric and magnetic field simulations that are not limited to paraxial cases. The electric sector disclosed herein introduces an array of segmented electrodes spanning the electric sector that prevents the loss of symmetry and field uniformity in other wide gap electric sectors. Further, the segmented electrode array disclosed herein enables placement of a nearby arbitrary electric field profile in the electric sector gap. To achieve maximum performance, a Mattauch-Herzog mass spectrograph using an electric sector disclosed herein can have its sectors adjusted in space and field magnitude via computerized optimization. Electrode arrays above and below the optical plane in charged particle systems are disclosed herein with sector position optimization. Described herein are four cases of electric sector and Mattauch-Herzog mass spectrograph-style mass spectrographs including a narrow gap electric sector, a wide gap electric sector, a wide gap electric sector with segmented electrodes and logarithmic field profile, and a wide gap electric sector with segmented electrodes and a linear field profile. These four cases have been simulated and compared for aperture imaging quality.

Table 1 below shows example geometric parameters of a Mattauch-Herzog mass spectrometer shown in FIG. 1A.

TABLE 1

| Symbol | Geometric Dimension | Ideal Theoretical Value | Experimental Value |
|---|---|---|---|
| $L_1$ | Aperture to E-Sector Distance | $L_1$ | 35.35 mm |
| $R_E$ | Electric Sector Centerline Radius | $\sqrt{2}L_1$ | 50 mm |
| $L_2$ | E-Sector to Magnet Distance | $L_2$ | 20 mm |
| $L_3$ | Magnet to Sensor Distance | 0 | 1 mm* |
| $R_M$ | Ion Radius in Magnetic sector | $\frac{1}{B}\sqrt{\frac{2Vm}{q}}$ | 25.75 mm** |
| $\varphi_E$ | Geometric angle of electric sector | $\frac{\pi}{4\sqrt{2}}$ | 31.8° |
| $\varphi_M$ | Angle ions travel in magnetic sector | $\frac{\pi}{2}$ | $\frac{\pi}{2}$ |
| $\varepsilon_1$ | Magnetic sector entrance angle | 0 | 0 |
| $\varepsilon_2$ | Magnetic sector exit angle | $-\frac{\pi}{4}$ | $-\frac{\pi}{4}$ |
| B | Magnetic Field Strength | B | 1.05 T |
| V | Ion Accelerating Potential | V | 800 Volts |

Ideal theoretical values are those inherenet to the Mattauch-Herzog geometry.
*This value deviates from the theoretical value due to detector fabrication constraints.
**$R_M$ for 40 m/z charged particles.

In experimentations, the four mass spectrograph geometries were designed and optimized via computer simulation. Utilizing high-fidelity finite-element generated electric and magnetic fields and a custom particle tracing routine, an accurate model of each mass spectrograph was developed. Through iterative simulations, the mass spectrograph design was optimized around its ability to transfer large spatially encoded arrays of ion beams with optimum uniformity of mass resolving power and minimum spatial distortion across the pattern. This was accomplished through computational optimization involving slight adjustments of the positions/rotation of components and the magnitudes of the applied electric fields.

The electric and magnetic fields of the mass spectrograph were calculated using the COMSOL 4.3b finite element multiphysics simulation platform. Simulation of the electric and magnetic fields was performed in three-dimensions (3D). The optical midplane of the 3D system's electric and magnetic fields was exported into regularly spaced 2D arrays. Three arrays were exported: the x- and y-components of the electric field, and the z-component of the magnetic field ($E_x$, $E_y$, and $B_z$). The coordinate system used is shown by the axes in FIG. 1A. Exporting the midplane fields as 2D arrays makes three assumptions: 1) The electric and magnetic fields do not vary much in z, 2) The z-component of the electric field is small, 3) The x- and y-components of the magnetic field are small. These assumptions were made because computational limitations made fast 3D particle tracing impractical, and are valid in this case due to the symmetry in the system and to fact that most particle trajectories are constrained close to this plane. The 1 Tesla magnet was simulated assuming the magnet and yoke do not experience magnetic saturation, which was deemed valid for simulations performed on magnets with similar strengths and yoke construction. Field values were recorded with a spatial resolution of 15 microns for use in the particle tracing.

Figure 1B:
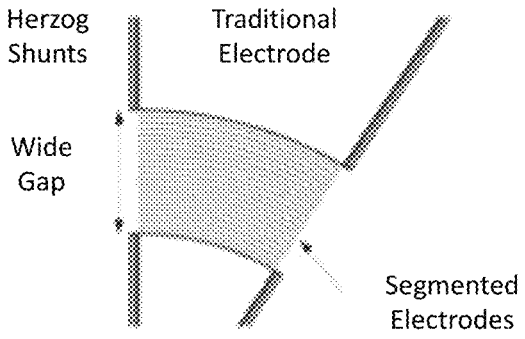
FIG. 1B illustrates a top view of an example wide gap electric sector using segmented electrode caps to create field profile and allow a wide aperture to completely pass in accordance with embodiments of the present disclosure.
Figure 2:
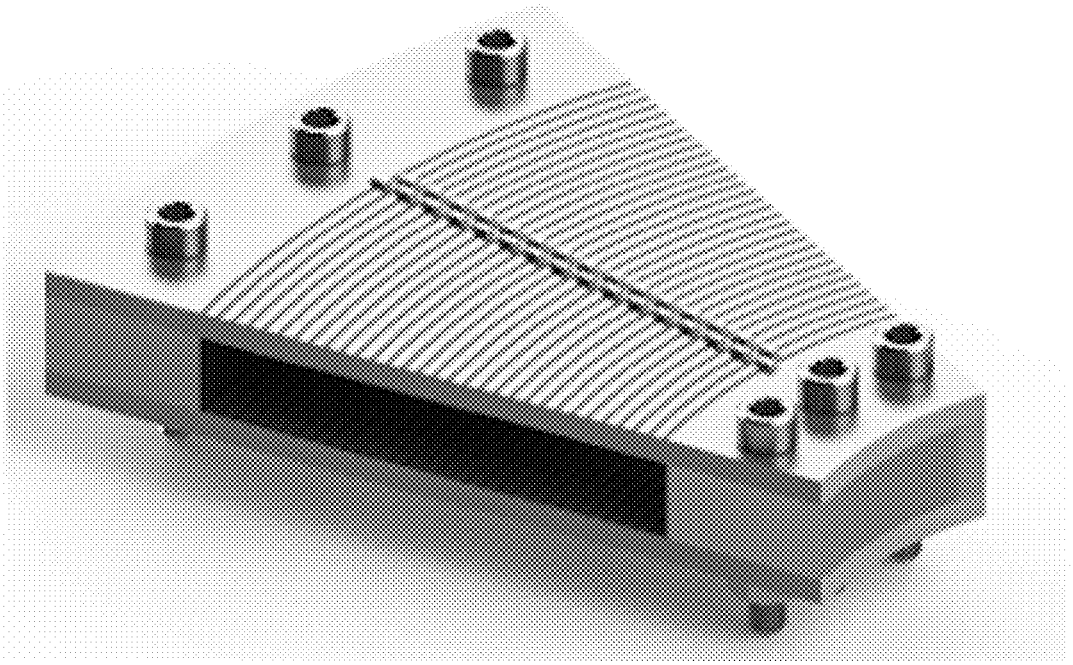
FIG. 2 is a photorealistic rendering of the electric sector shown in FIG. 1B.

FIG. 1B illustrates a top view of an example wide gap electric sector using segmented electrode caps to create field profile and allow a wide aperture to completely pass in accordance with embodiments of the present disclosure. FIG. 2 is a photorealistic rendering of the electric sector shown in FIG. 1B.

Electric and magnetic fields were exported from COMSOL to a custom C#particle tracer program for fast iterations of electric field strengths and sector positions/rotations needed for optimization of sector geometries. Further, the computational speed of our custom particle tracing allowed for rapid evaluation of test geometries. Particle tracing was handled with time steps of 1 picosecond and bilinear interpolation of the 2D midplane fields exported from the COMSOL simulations.

The particle tracing program had two main tasks. First, it generated large numbers of ions with realistic distributions of energy and direction vectors. Second, it passed these ions through the simulated fields of the system with high precision. This simulation approach allows for high speed simulations with very small time steps and is therefore able to accurately account for fringing fields. The C# code evaluated more than $10^6$ time steps along each ion's trajectory. The effects of these fringing fields are of critical importance in miniaturized systems due to the large fraction of the ions' total flight path that are affected by fringing fields.

The COMSOL-C# combined approach allowed for fast simulation of particle trajectories substantially faster than could have done. In addition to calculation speed, the C#tracer allows for the simulation of highly asymmetric geometries with high fidelity. This particle tracing fidelity is 100× higher than the best that could be achieved using the COMSOL particle tracing module on the same workstation (1× Intel Xeon E3-1275 V2 @ 3.50 GHz; 32 GB RAM) and produced particle trajectories with many fewer discretization errors based on the resulting histogram patterns.

Simulations according to the present subject matter used ions representative of a typical ion source as follows. Particle tracing figures and optimization used 20 atomic mass unit (AMU) and 200 AMU ions with initial positions of −4, −2, 0, 2, and 4 mm relative to ion source center; angles of −0.01, −0.005, 0, 0.005, and 0.01 radians relative to the beamline; and energies of 798, 799, 800, 801, 802 eV (2 masses*5 positions*5 angles*5 energies=250 ions total). Histograms used 200 AMU ions with positions along the open portions of a randomly generated coded aperture pattern with 103 positions (open or closed) with 100 micron feature size shown in Histogram (e) of FIG. 15. This code is referred to as an order 103 code. Angles were uniformly distributed from −0.01 to 0.01 radians, and energies chosen from a normal distribution with mean 800 eV and FWHM of 2 eV (250,000 ions emitted per histogram, less hit in case 1). In an actual system, ions are more realistically modeled as a point source some distance behind an aperture plane; however here there is an assumption of a series of point sources on the aperture plane, which is a conservative approach (i.e., at the upper limit of dispersion in a real system), thereby allowing simulation of a worst-case scenario.

The electric sectors disclosed herein and shown in FIGS. 1B and 2 operate differently than traditional electric sectors, so parametric optimization was utilized to discover the best way to incorporate them into the spectrograph design. The chosen optimization routine was a combination of the Nelder-Mead (simplex) algorithm and manual adjustment. To enable design turns in a reasonable time frame the particle tracer was written so that the ion source position, magnetic field position, and electric field magnitude could be adjusted instantaneously. One caveat of this approach is that the shape of the electric sector (angle and centerline radius) and the shape of the magnet cannot be adjusted as quickly (requiring rerunning the relatively slow field simulation in COMSOL), and were therefore not allowed the freedom to change in the optimizer. While it is undesirable that there exist parameters which cannot easy be adjusted, fixing these parameters allowed a local optimum in design to be reached in a reasonable computational time frame. Since the coded aperture, which patterns the ion source, and the magnet in this spectrometer are electrical conductors, if they get too close to the electric sector then the electric sector's field may be affected. Thus, although the positions of these components are allowed to vary in the optimizer, constraints were imposed to restrict their movement to a range in which they were not substantially coupled to the field of the electric sector.

Once fields were exported from COMSOL and ion source properties determined, ion source position, magnet position and rotation, and electric sector magnitude were varied. The C# particle tracer calculated ion trajectories and the positions of the particles on the detector. For optimization, 250 particles were simulated: 125 for a mass of 20 AMU and 125 for a mass of 200 AMU as described above. For each position on the aperture, it is desired that the 25 ions (five angles and five energies) hit the sensor at the same place. The 25 ions do not hit exactly the same place, but instead impact in a cluster. The size of this cluster is calculated ten times (five positions on the aperture and two masses). These sizes are then averaged, giving a figure of merit for the mass spectrograph. If any of the 250 ions do not strike the sensor, the design was rejected. The Mathematica function takes spectrograph parameters and returns a single number representing focus; this allows optimization to occur.

To illustrate the improvements provided by the present disclosure, four simulated cases of electric sector designs integrated into mass spectrographs are presented. Each case is based upon or modified from the MHMS used by Russell et. al[8] and details of their configurations are presented Table 1. Case 1 is a traditional MHMS geometry with a narrow gap electric sector. Case 2 is a MHMS geometry with a wider electric sector gap but is otherwise identical to the first case. Case 3 has an electric sector like that shown in FIG. 2 with a logarithmic potential profile applied to the electrode arrays, and has an electric sector field very similar to that of Case 2 by design. Case 4 also utilizes an electric sector like that shown in FIG. 2 except with potentials varying linearly with radial coordinate applied to the electrode arrays, giving a field that is constant with respect to radial coordinate. The geometries of cases 3 and 4 were optimized by adjusting the position of the ion source and both the position and rotation of the magnet and the electric field strength. The resulting simulated transfer of an order n-103 1D spatially coded aperture array of ions through each system is shown in FIG. 15 and the results for each case are discussed below.

Figure 15:
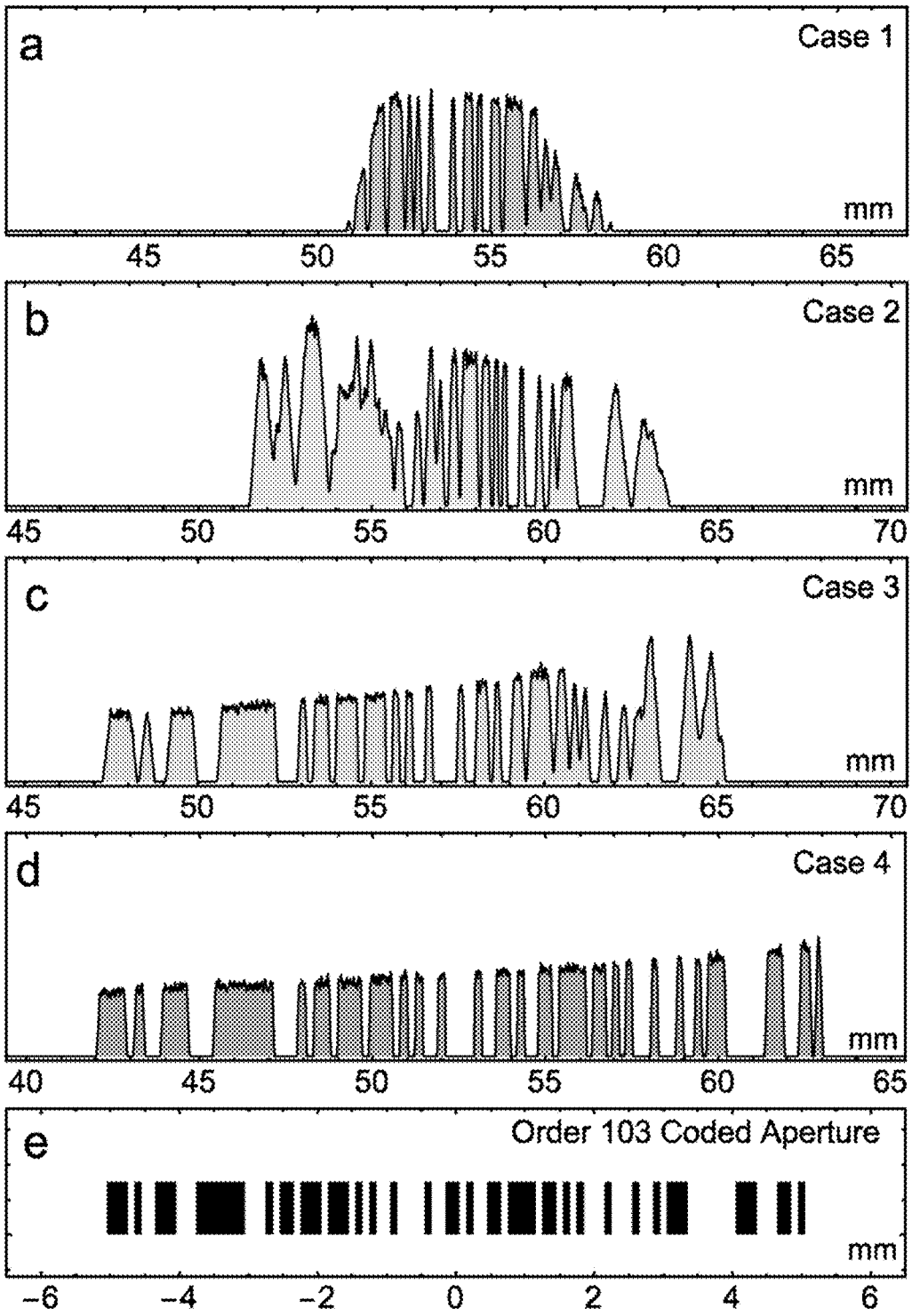
FIG. 15 illustrates histograms of an order 103 aperture generated by emitting 250,000 200 AMU ions for the four cases.

FIG. 15 illustrates histograms of an order 103 aperture generated by emitting 250,000 200 AMU ions for the four cases. Histogram (a) is Case 1 and transmits the entire pattern. Histogram (b) is Case 2 and transmits all ions but the edges are poorly resolved. Histogram (c) shows Case 3, which is effectively an optimization of case 2, passes and somewhat resolves the aperture, but retains a notable performance decrease at the edges. Histogram (d) Case 4 which transmits a fully resolvable pattern enabling 50× increase in total signal using segmented electric sectors and a linear field profile, with only slight resolution degradation at the edges of the pattern. Histogram (e) shows randomly generated 1D Spatially Coded Aperture Pattern of Order 103 enabling 50× increase in throughput.

Table 2 below shows geometric and field parameters for the four cases. Cases 1 and 2 use traditional MHMS sector and source positions. Case 3 and 4 are optimized for focus. It should be noted that the L2 distance is limited to 15 mm by the optimizer, and some parameters have not been optimized.

| Variable | Case 1 | Case 2 | Case 3 | Case 4 |
|---|---|---|---|---|
| $L_1$ | 35.18 mm | 35.18 mm | 15.88 mm | 16.15 mm |
| | Distance from aperture to start of electric sector | | | |
| $\Phi_E$ | 31.8 deg* | 31.8 deg* | 31.8 deg* | 31.8 deg* |
| | Geometric angle of electric sector electrodes | | | |
| $R_E$ | 49.8 mm* | 49.8 mm* | 49.8 mm* | 49.8 mm* |
| | Electric sector centerline radius | | | |
| $L_2$ | 20 mm | 20 mm | 22.8 mm | 15 mm* |

Case 1 represents a traditional MHMS mass spectrometer. Its electric sector has a 5 mm gap, large height, and no electrode arrays. Sector positions are that for traditional MHMS. Table 2 provides additional geometric parameters of Case 1. When attempting to pass the encoded ion beam pattern from the order 103 aperture shown in Histogram (e), the narrow electric sector only allows a small portion of the aperture to pass. These results are presented in Histogram (a). The central portion of the aperture image is well-imaged which matches with the way this instrument was typically used for near central axis beams. As it moves further from the center beam line, there is significant distortion of the aperture image and Case 1 does not allow all the ions through.

Case 2 is the same as case 1, but with a 4× wider electric sector gap of 20 mm. Sector positions are that for traditional MHMS and are presented in Table 2. Histogram (b) shows a comparison of the coded aperture and the image on the detector. In this case, due to the wide electric sector, more of the ions are able to pass through the electric sector. However, due to the poor symmetry and uniformity of the field the image of the aperture is distorted. It is believed that a combination of fringing fields close to the electric sector, field non-uniformity, and the potential along the centerline being nonzero in the electric sector are responsible for the reduced performance of Case 1 compared to later cases.

In addition to the non-optimized wide gap sector presented in case 2, ions were run through an unoptimized Case 3 geometry. Case 3 is very similar to case 2, but employs the segmented electrodes, shorter electric sector height, and optimization of sector positions/magnet rotation and electric field magnitude. Since unoptimized Case 3's fields are designed to be a representation of Case 2's fields in a smaller form factor, they yield very similar results. Therefore, the results of this unoptimized case 3 are not substantially different than the optimized case 3 geometry presented below and are not presented in figures to avoid redundancy.

Case 3 has the same electric sector width as Case 2, but employs the segmented electrodes and a shorter height. Its electric sector has 20 mm gap, 5-6 mm height, and electrode arrays with electric potentials according to equation (1) applied, with additional parameters as shown in Table 2. FIG. 15C shows the encoded ion pattern of the aperture in FIG. 15E when passed through this system. The aperture's projection on the sensor is much better than Case 2, but its resolution still deteriorates for ions away from the central axis. While this case uses the application of a traditional logarithmic field profile, since the electrodes on the caps can be assigned any voltage we can create other electric field profiles within this sector to improve on its performance and correct for aberrations in the system such as astigmatism.

Case 4 utilizes the same segmented electrode electric sector as case 3, but with a linear potential profile applied to the segmented electrodes. The electric sector has 20 mm gap, 5-6 mm height, and electrode arrays with linear electric potentials applied. Sector positions and electric field strength are optimized for high order coded apertures and Table 2 provides additional detailed parameters. FIG. 15D shows the image of the pattern transfer of the order 103 aperture through this geometry. The entire order 103 aperture is fully resolved while in the other cases is the pattern was either clipped or not resolved near the edges. While alternative field profiles are also possible, from the cases we have studied this field yields the best result, with a 1D order 103 spatially coded aperture fully resolved along its entire width. The other three cases presented here fail to resolve the entire high order aperture pattern, with decreased performance further from the center line. It is believed that the combination of the linear potential and sector position/rotation adjustments cancels out influences of the electric sector's fringing fields and the uniform electric field does not suffer from negative off-axial effects a non-uniform electric field can introduce into the trajectories.

The segmented electrodes presented herein have shown the capability of not only reducing the volume footprint of the electric sector, but also the capability of producing non-traditional and somewhat arbitrary field profiles across a gap. This capability can be used to provide an optimal field which can correct for beam aberrations and/or stigmate pattern transfer in a beam imaging system. For example, by applying the linearly varying potential profile of Case 4 and performing a geometric and potential optimization to maximize focus, a mass spectrograph configuration with stigmated coded aperture pattern transfer has been achieved. FIGS. 17A-17D illustrate the field improvements that can be realized with electrode arrays and linear potentials applied to the arrays. A virtually arbitrary set of voltages can be applied to the segmented electrodes to produce different field profiles from those created from conventional lens systems.

Figure 16A:
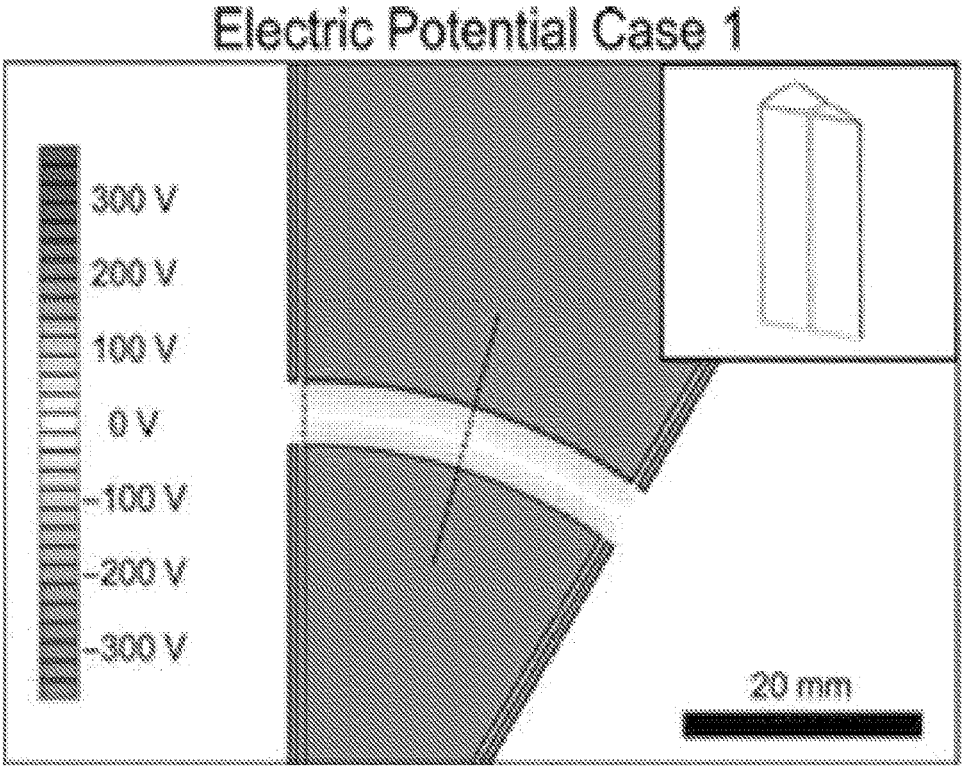
FIG. 16A shows a traditional narrow gap electric sector for MHMS.
Figure 16B:
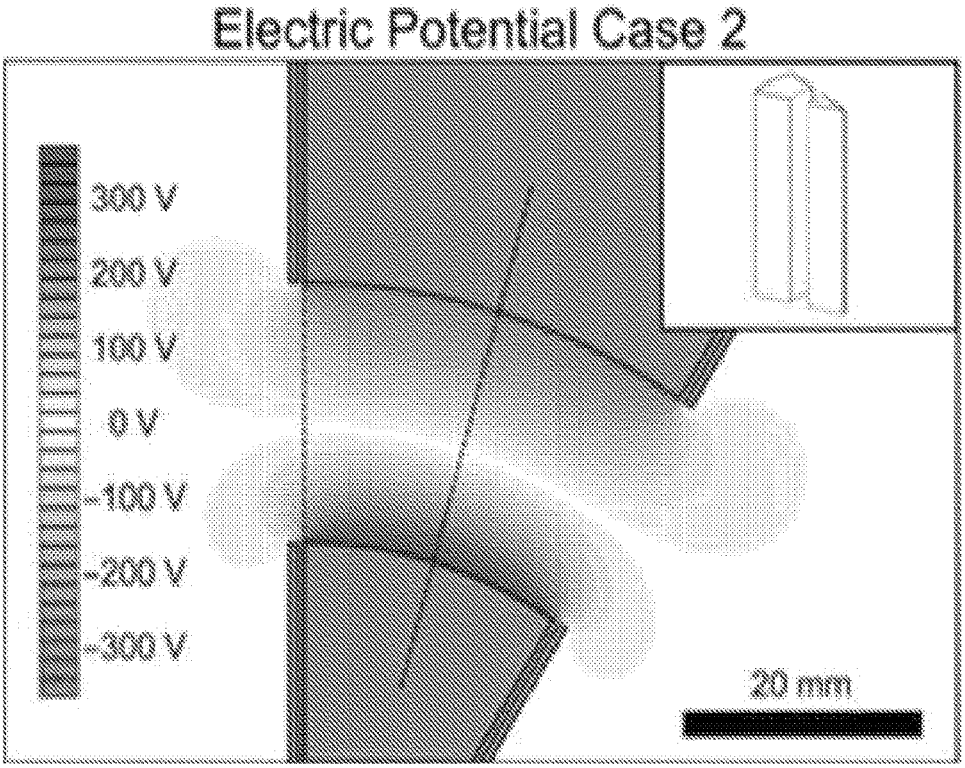
FIG. 16B shows a traditional electric sector with gap widened to allow higher order encoded ion beams.
Figure 16C:
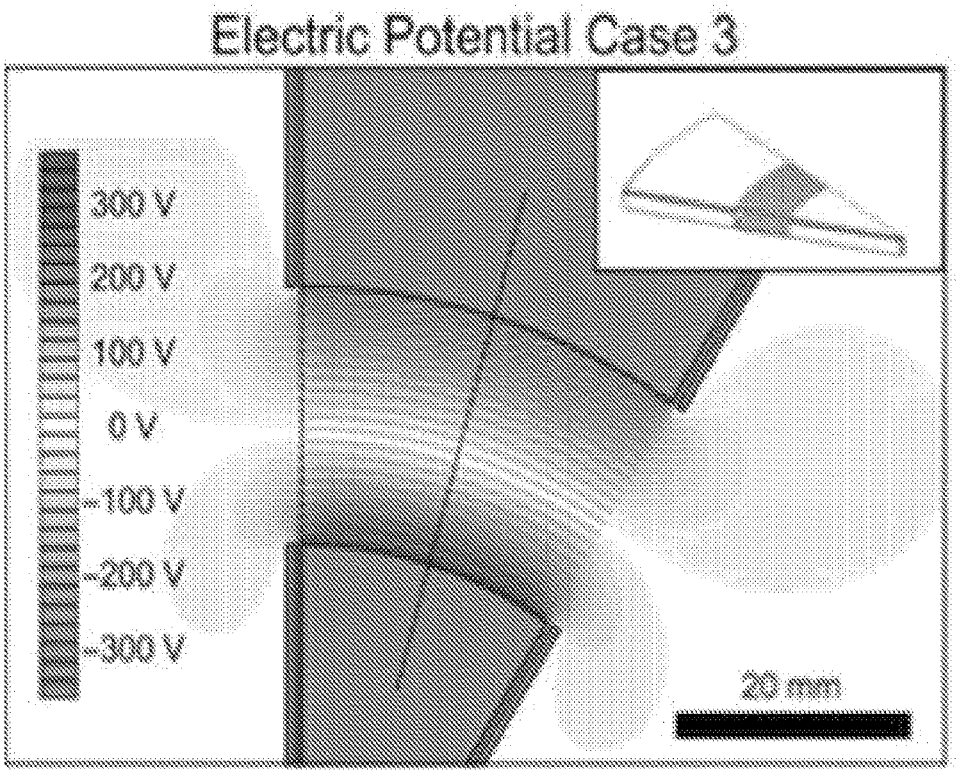
FIG. 16C shows a segmented sector with field profile for emulating a particular case.
Figure 16D:
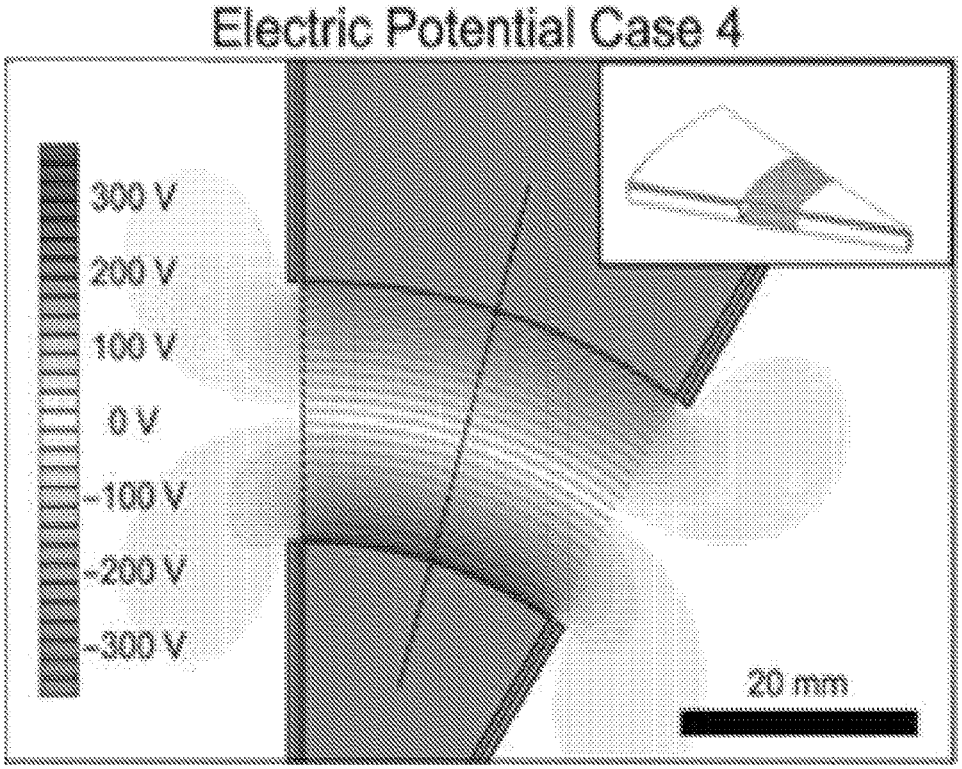
FIG. 16D shows a segmented sector design with linear potential gradient imposed across the span.

Each of the four electric sector configurations is shown in FIGS. 16A-16D with simulated electric field profiles. FIG. 16A shows a traditional narrow gap electric sector for MHMS. FIG. 16B shows a traditional electric sector with gap widened to allow higher order encoded ion beams. FIG. 16C shows a segmented sector with field profile for emulating Case 2. FIG. 16D shows a segmented sector design with linear potential gradient imposed across the span. The field profiles shown are slices along the optical midplane of each case's electric sector geometry. As seen most clearly from Cases 2 and 3, the fringing fields at the entrance and exit of the electric sector pole faces extend significantly beyond the pole face of each sector. It can also be seen from these simulations that the electric fields of FIGS. 16B and 16C are highly asymmetrical about the optical axis with respect to radial coordinate. It is believed that this asymmetry to be responsible for the reduced resolution of instruments designed with wide gap sectors. This observation implies that pattern distortion and resolution loss can occur from these wide gaps.

Figure 17A:
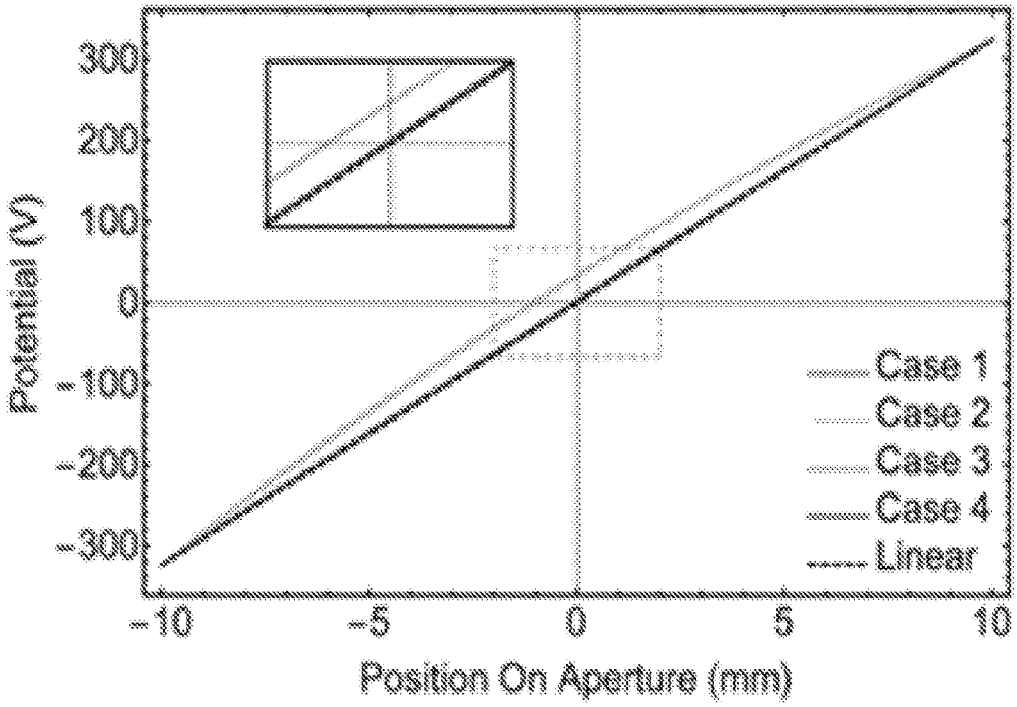
FIG. 17A shows electric potential at dashed lines in the center of the sectors shown in (a) of FIG. 15.
Figure 17B:
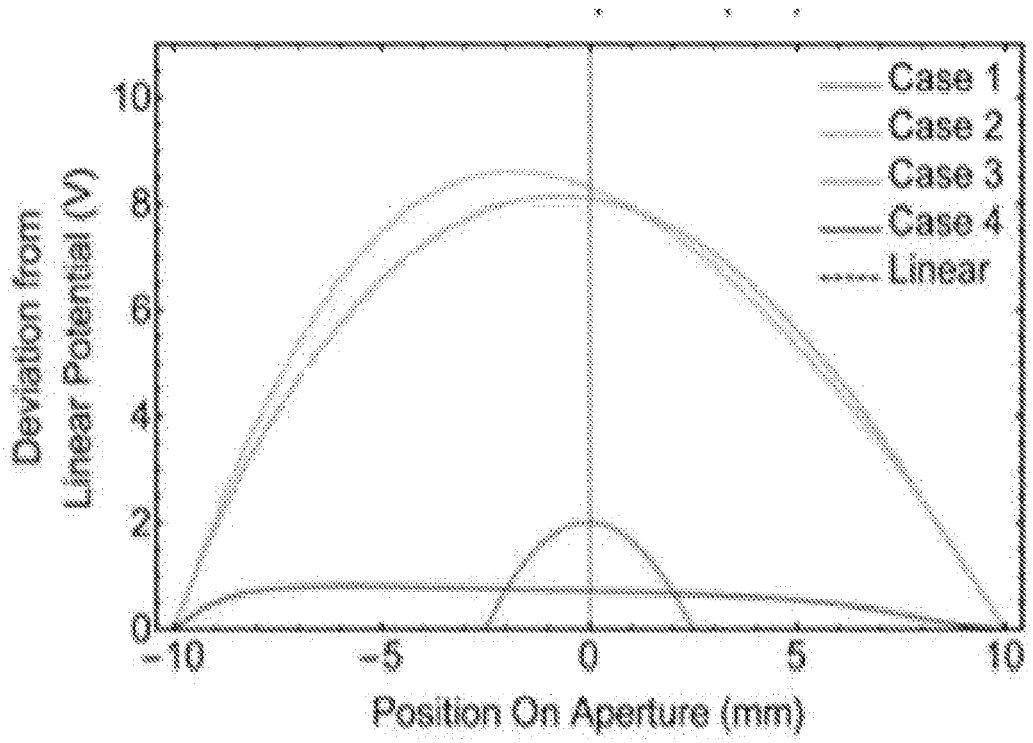
FIG. 17B is electric potential at dashed lines in the center of sector shown in FIG. 15 relative to linear profile.
Figure 17C:
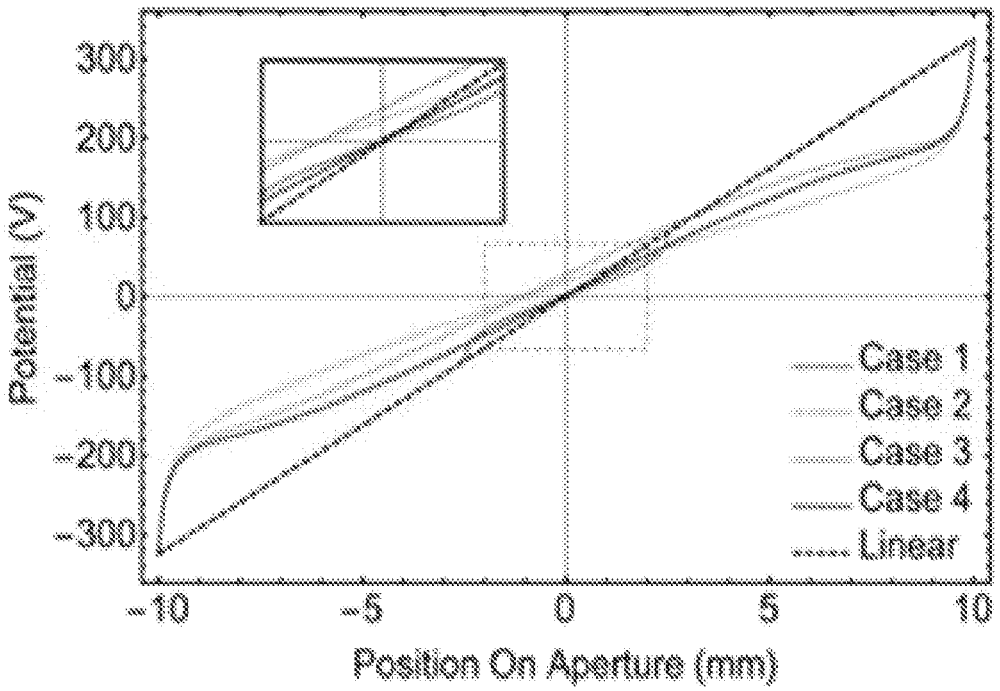
FIG. 17C shows electric potential at dashed lines at entrance of sectors in FIG. 15.
Figure 17D:
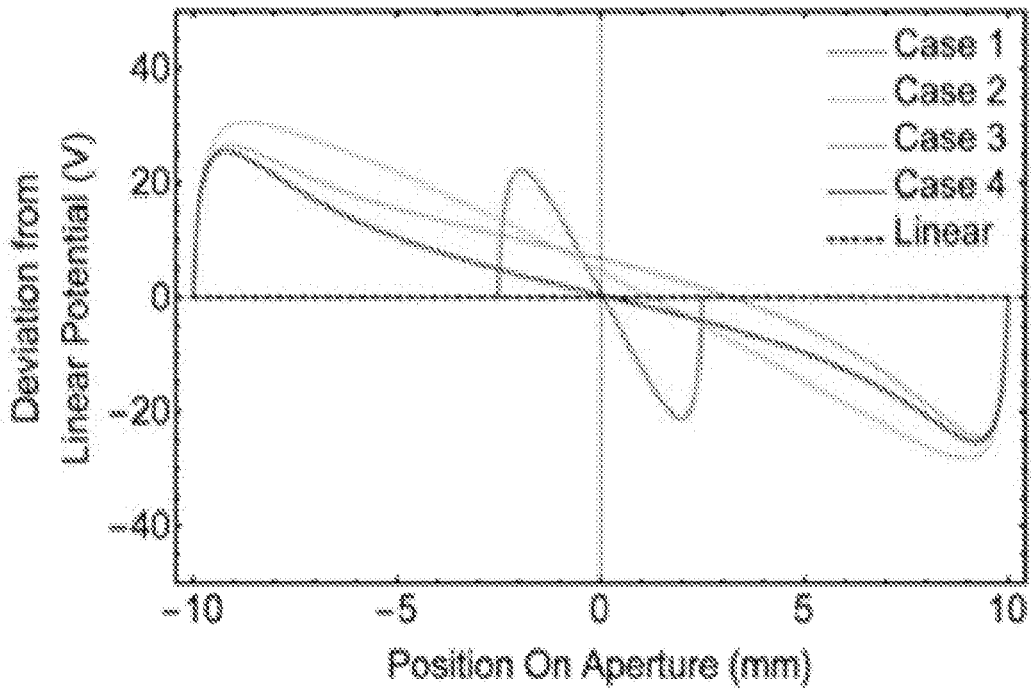
FIG. 17D shows electric potential at dashed lines at the entrance of sectors in FIG. 15 relative to linear profile.
Figure 18A:
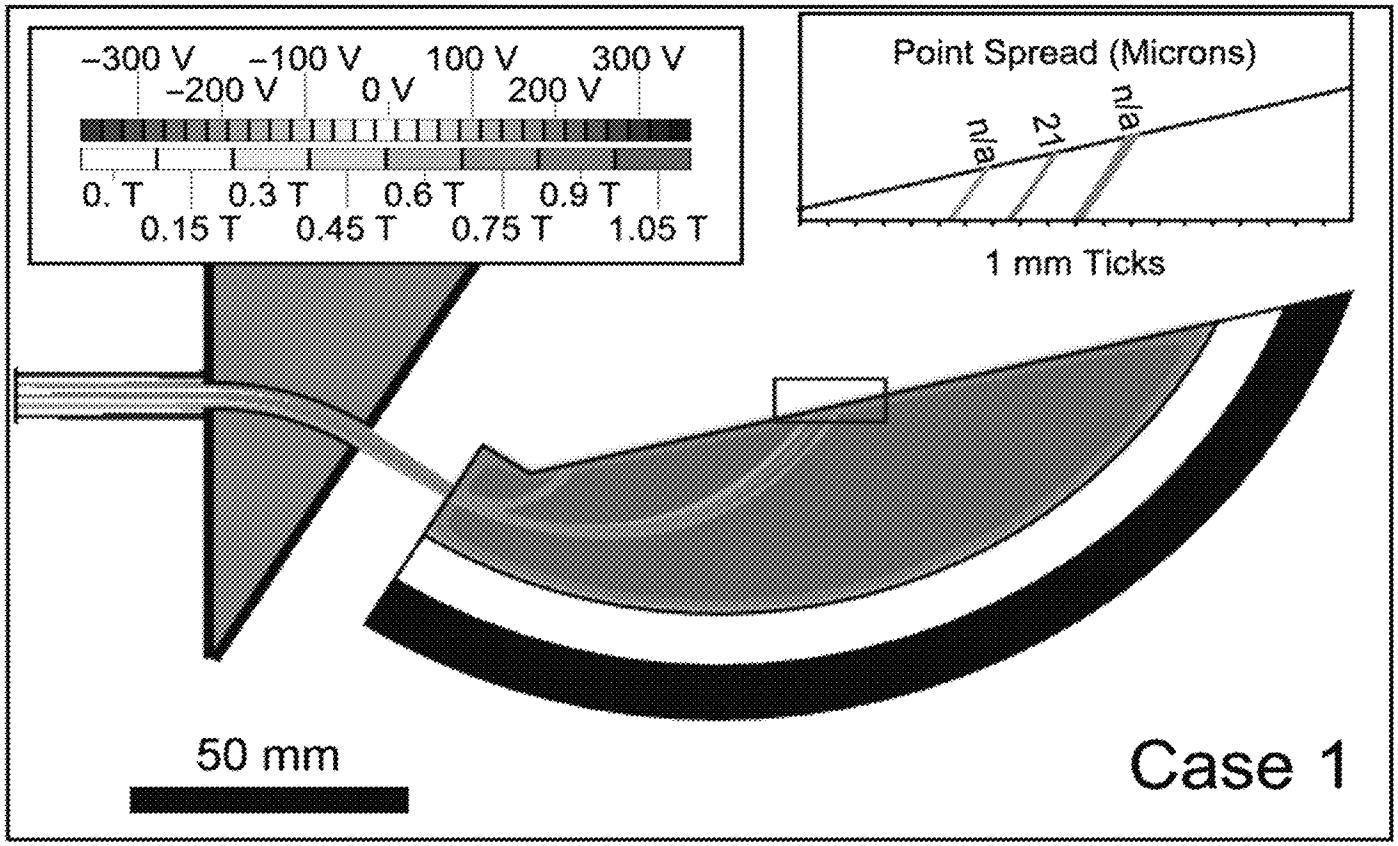
FIGS. 18A-18D show a comprehensive comparison of the results from the geometries of Cases 1-4.
Figure 18B:
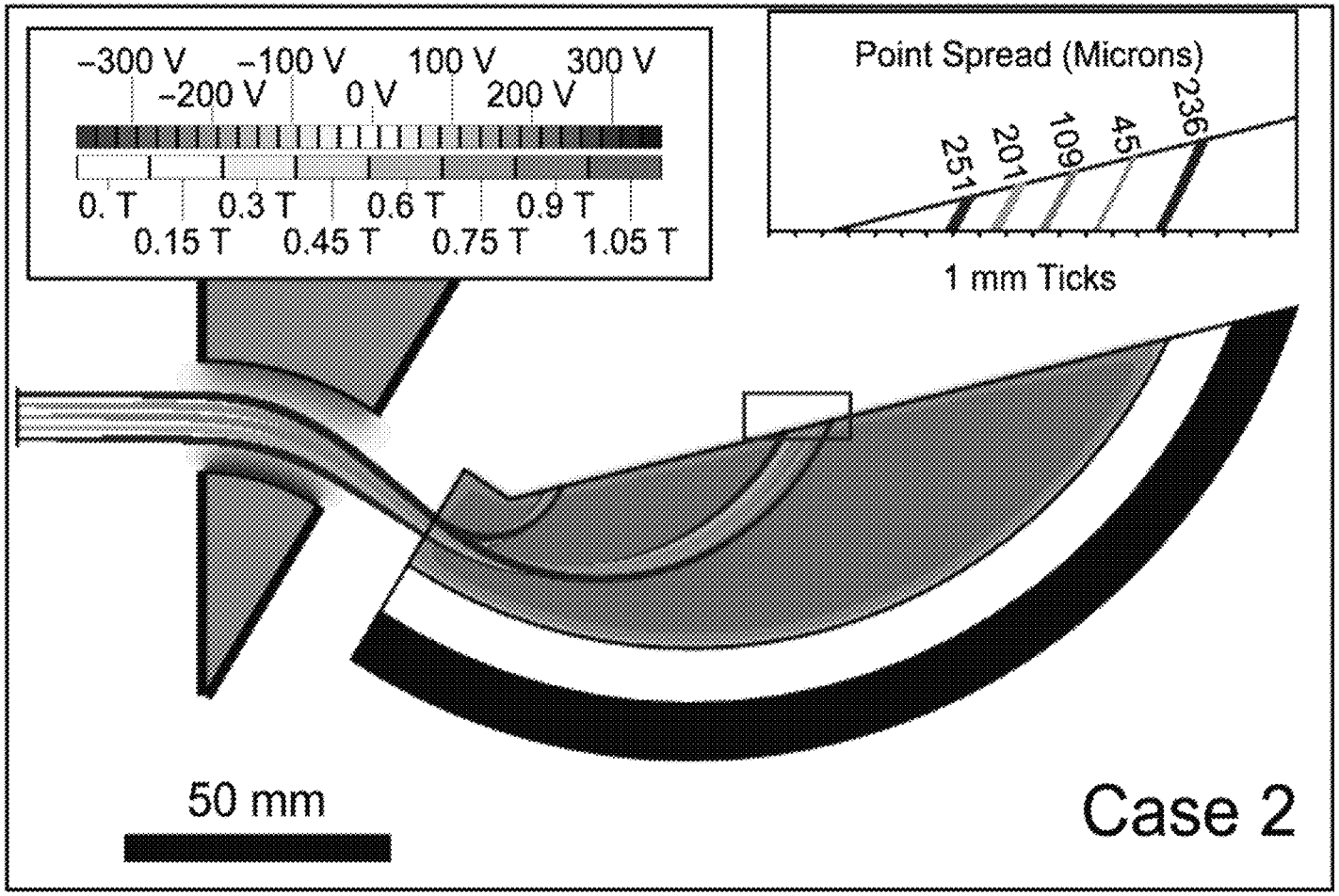
Figure 18C:
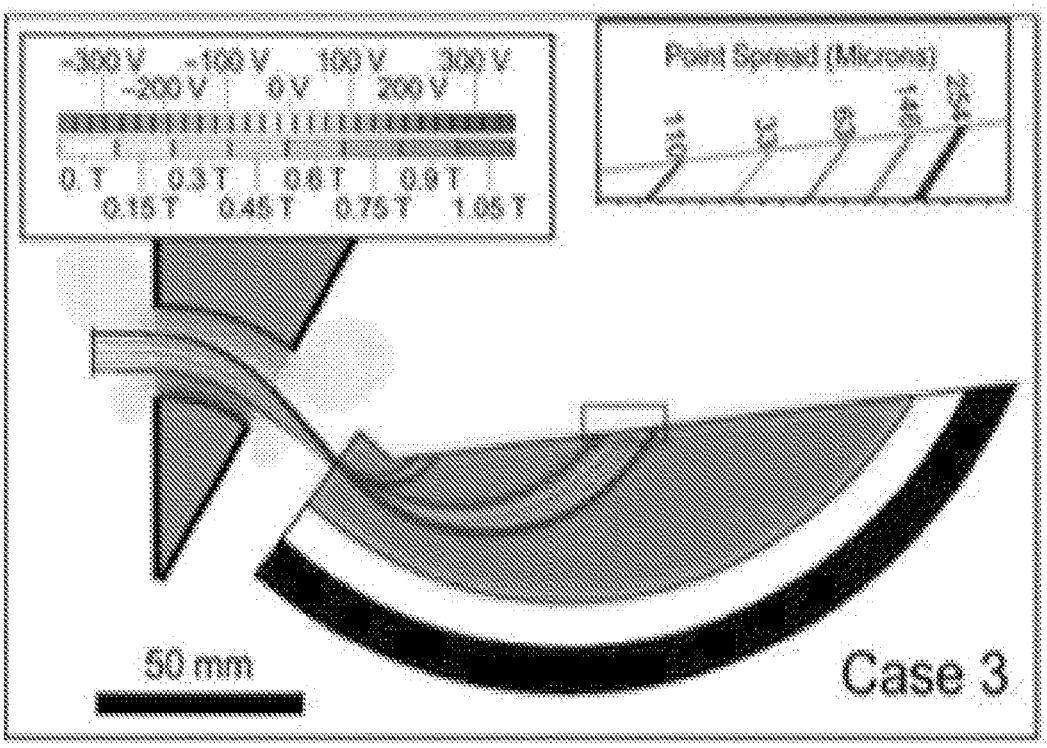
Figure 18D:
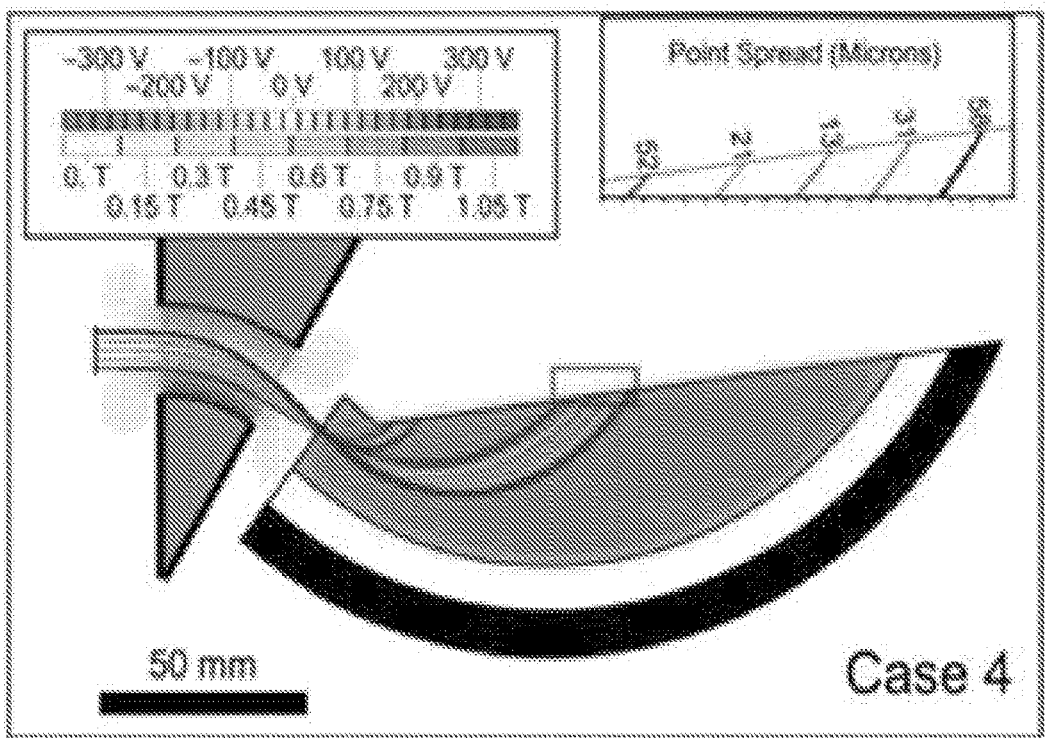

FIGS. 17A-17D illustrate that the narrow gap electric sector and the linear segmented sector (Cases 1 and 4 respectively) both closely map to a linear potential profile across the gap, as well as having only a small offset from the linear potential profile at the center of the sector gap. FIG. 17A shows electric potential at dashed lines in the center of the sectors shown in (a) of FIG. 15. FIG. 17B is electric potential at dashed lines in the center of sector shown in FIG. 15 relative to linear profile. FIG. 17C shows electric potential at dashed lines at entrance of sectors in FIG. 15. FIG. 17D shows electric potential at dashed lines at the entrance of sectors in FIG. 15 relative to linear profile. Case 2 as well as Case 3, which mimics Case 2 but with a lower height, both suffer from a strong offset from the linear potential profile. This may be attributed to the increased performance near the centerline of Case 1 and 4 compared to 2 and 3 to this field offset. It should be noted that an optimization was performed to determine the best potential array using linear combinations of a field proportional to 1/r (equation (1)) and a field constant with respect to r, but the field which is almost constant with r (and therefore the potential which varies almost linearly with r) resulted in the best performance.

Another problem with wide-gap sectors is that to provide the fields depicted in FIGS. 16A and 15B the height of the electric sector (into and out of the page in FIGS. 16A-16D) needs to be much greater than the width of the sector gap. It is readily apparent that this volume footprint is unfavorable when designing any system, but is especially unfavorable for miniaturized systems. In order to reduce the form factor of such wide gap electric sectors, a new class of electric sector lenses is proposed and simulated herein. The design shown in FIGS. 1B and 2 incorporates electrode "caps" with individually addressable "segmented" electrodes across their span. These segmented electrodes on the caps are used to impose a field profile across a large gap. These proposed segmented electric sectors are capable of not only reproducing the field profile of large gap electric sectors with much lower volume footprints (due to reduced height requirements), but are also capable of producing more arbitrary field profiles across the gap. FIGS. 17A-17D show simulated field profiles for a mapping of the theoretical ideal potential profile from Equation (1) and a uniform linearly varying potential profile, which can all be created using these new electric sectors.

$$V(r) = \Delta V * \left( -\frac{1}{2} + \frac{\ln\left(-\frac{2r}{eGap - 2R_E}\right)}{\ln\left(-\frac{eGap + 2R_E}{eGap - 2R_E}\right)} \right) \quad (1)$$

where ΔV is the voltage between the inner and outer electrodes of the electric sector, r is radial coordinate in the electric sector, RE is the radius of the optical axis in the electric sector, and eGap is the gap between the inner and outer electrodes of the electric sector. For narrow gaps, the potential profile of equation (1) matches closely to a linear profile, as shown FIGS. 17A and 16B, but for wider gaps this starts to vary widely. This may be the cause of the poor performance of wide-gap electric sectors.

A comprehensive comparison of the results from the geometries of Cases 1-4 is presented in FIGS. 18A-18D. These figures show different electric sector fields, the positions of the sectors of the instrument must change to keep the instrument in focus. Field intensity changes as well, but is not visible here. The spot size for five spots with 2 mm initial spacing are visible in the inset, as well as their spacing. Cases 3 and 4 have tighter spots on the sensor than cases 1 and especially Case 2. Not all emitted ions for case 1 hit the sensor; as a result only one spot size can be calculated for Case 1. These figures showcase characteristic particle trajectories passed through each of the four cases, 1: traditional sector, 2: wide gap sector. 3: optimized segmented electric sector mimicking traditional sector fields, and 4: a linear field profile on a segmented electric sector after optimization. The insets in the top right of these figures show the point spread of five sample ion bundles origination from a spatial distribution across the aperture plane when propagated through the fields of the spectrographs onto a detector plane. The instruments were evaluated based on their ability to minimize the point spread functions of these distributions.

A more detailed version of the insets of FIGS. 18A-18D is presented in FIG. 15, showing the impact locations resulting from 250 k 200 AMU ions emitted from an order 103 coded aperture-based ion source and passed through the instrument (promising greater than 50× increase in signal intensity after reconstruction). FIG. 15A shows that the traditional sector does a reasonable job at focusing the ions originating from the central aperture, but ions to either side become either quickly defocused or impact the electric sector and are not detected. The wider gap sector of Case 2 represented in FIGS. 15A and 15B shows reduced ability to focus at its optimal spot compared to a narrow sector, and also becomes more distorted across its expanse rather quickly. The optimized stigmated sector mimicking traditional field profiles of Case 3 FIGS. 15C and 15D show a noticeable increase in the ability to stigmate the beam pattern, as the optimization has adjusted the geometry to account for the lensing occurring from the fringing fields of that system, but a decrease in resolving power and pattern transfer at the edges of high order patterns is still quite apparent. Only when we move to the linear field profile provided by a geometry optimized around segmented electric sectors do we see the improved results shown in FIGS. 15C and 15D. These results display a fully resolved spatially encoded beam profile of order 103, promising greater than 50× increase in signal intensity with minimal corresponding loss in resolving power when reconstructed as demonstrated in previous work.

Figure 19A:
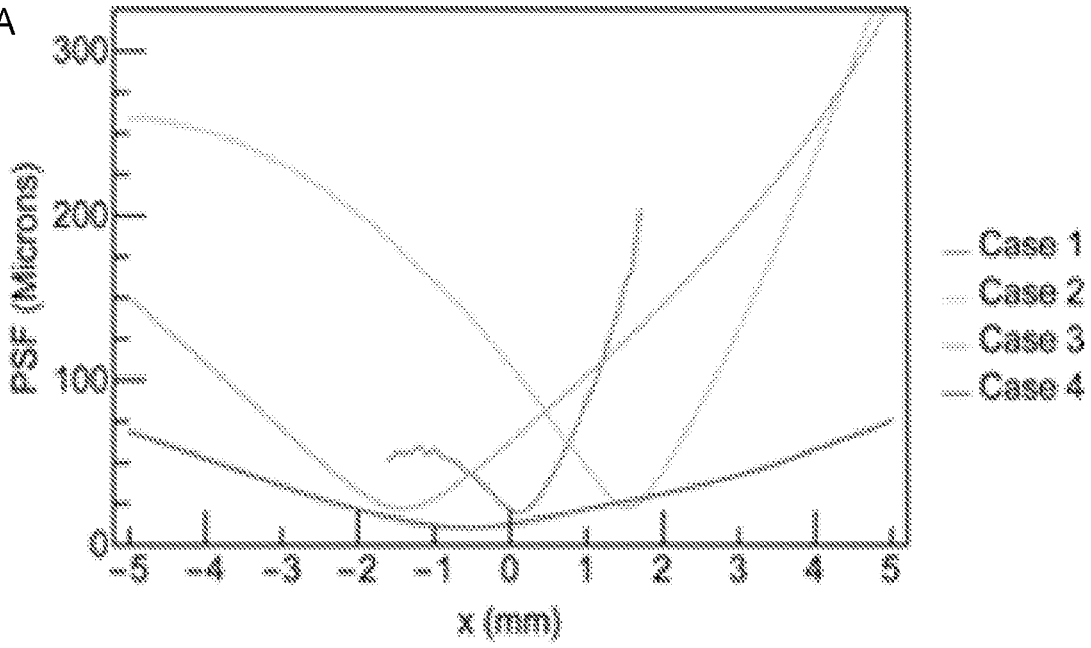
FIG. 19A is a graph representation of a performance of a mass spectrograph in a normal scale.
Figure 19B:
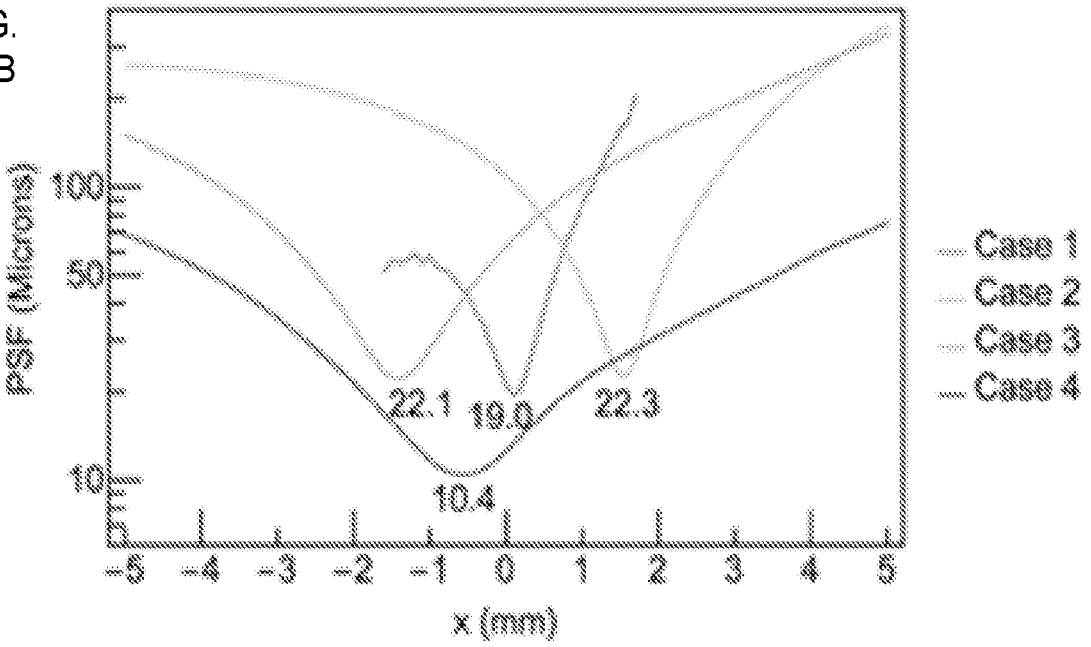
FIG. 19B is a graph representation of a performance of a mass spectrograph in a log scale.

Further investigation of this performance increase produces the curves as presented FIGS. 19A and 19B. Here in each of the four cases the standard deviation of the spot size for 200 AMU ions is shown as a function of their starting position on the aperture planes from Table 2 and depicted in FIGS. 18A-18D. The center of the aperture is represented by 0 mm. Cases 1-4 are represented on a linear scale (FIG. 19A) and on a log scale (FIG. 19B). It can be seen in FIG. 19A that Case 4 of the linear field on the segmented electric sector does the best job at resolving the entire high-order coded aperture pattern. By examining the log scale perspective of FIG. 19B it can be seen that the ultimate resolving power of the linear field stigmated electric sector of Case 4 has an improvement in predicted mass resolving power of 1.8× that of the traditional unoptimized Mattauch-Herzog design.

Simulations and optimization of a novel stigmated double focusing mass spectrograph geometry that allows for higher order 1D spatially coded aperture patterns have been presented along with simulations of a traditional Mattauch-Herzog mass spectrograph (MHMS) it was based upon for comparison. The modifications include a novel electric sector design that enables image stigmation and aberration correction of spatially encoded beams, and an optimized geometric configuration of the above resulting in simulated pattern transfer of an order-103 aperture. This result in an over 50× increase in signal intensity when using an order-103 coded aperture as well as an increase in ultimate mass resolving power by a factor of 1.8× when operated as a single slit instrument. The most notable modification was the application of a linear electric field profile provided by a segmented electric sector. The described electric sector has a very small form factor and can be made simply and inexpensively. This stigmated double focusing mass spectrograph design will allow increased miniaturization of magnetic sector mass spectrographs, expanding their application. The proposed electric sector and mass spectrograph design can also be used to increase the resolution of laboratory-sized instruments.

By using a segmented electric sector with a linearly varying electric field in a Mattauch Herzog style mass spectrograph in accordance with embodiments of the present disclosure, a large spatially coded aperture patterns of ions may be passed through a mass spectrograph and may produce a segmented image of the higher order coded apertures simultaneously across a wide mass range. Coded aperatures of this size in this spectrometer can enable improved mass spectrometer signal intensity. For example, the electric sector of the mass spectrograph shown in FIGS. 1A and 2 (designated "Electric Sector" in FIG. 1A, and "ESA −" and "ESA +" in FIG. 2) may be implemented in accordance with embodiments of the present disclosure. It is noted that conventional electric sectors for mass spectrometers and mass spectrographs typically include some radial fraction of two concentric cylindrical conductors with a gap across them in which a voltage is applied. This gap is typically as narrow as possible. More advanced techniques apply field shunts to the entrances and exits of the electric sectors to reduce aberrations caused by fringing fields. For coded aperture mass spectrometry, the gap between the two cylinder segment electrodes typically need to be so large to allow coded beams to pass that all of the lensing properties of the traditional design become dominated by aberrations.

Figure 3:
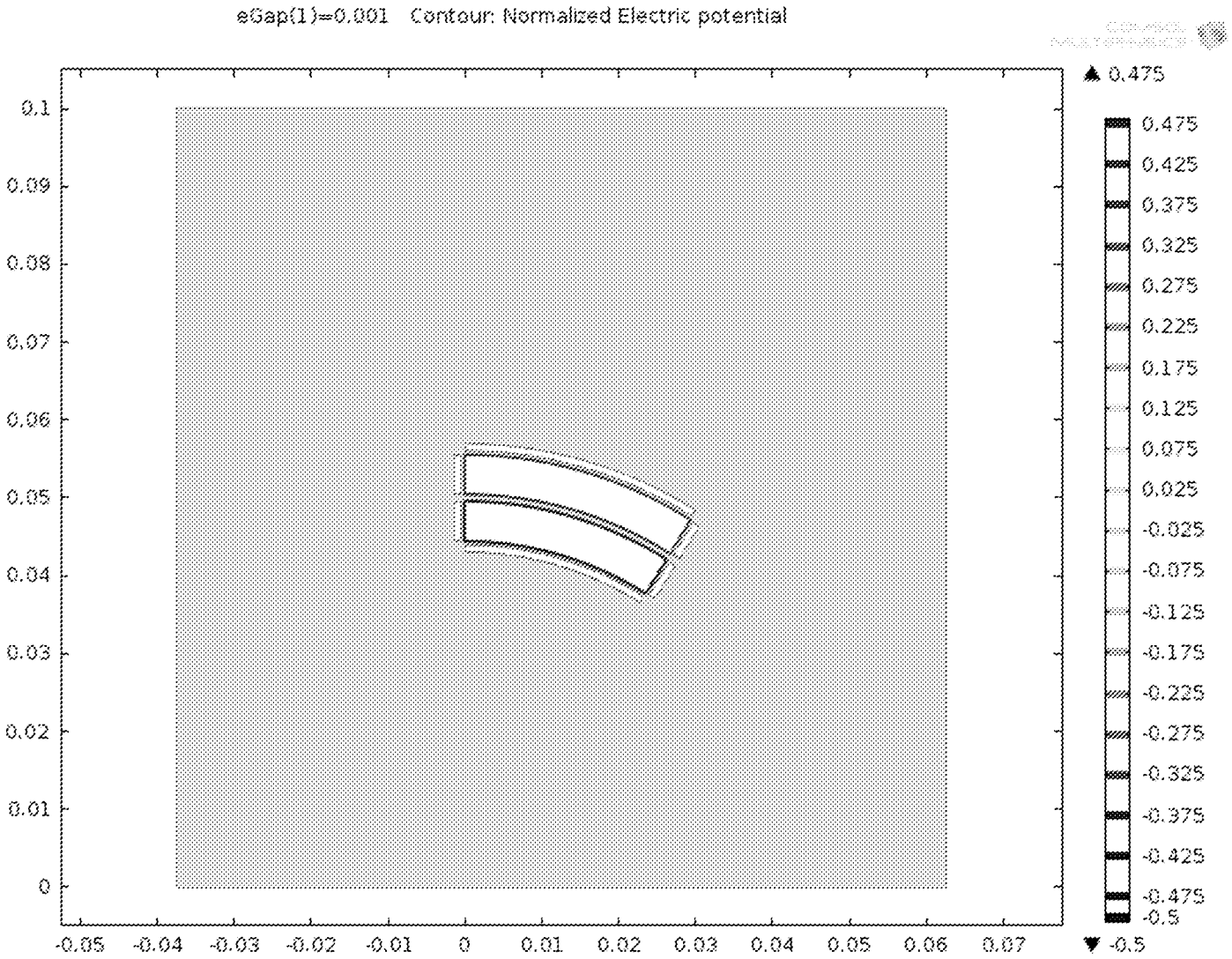
FIG. 3 are field maps for conventional electric sectors with increasing gap widths of 1, 2, 4, 8, 16, and 32 mm.
Figure 3:
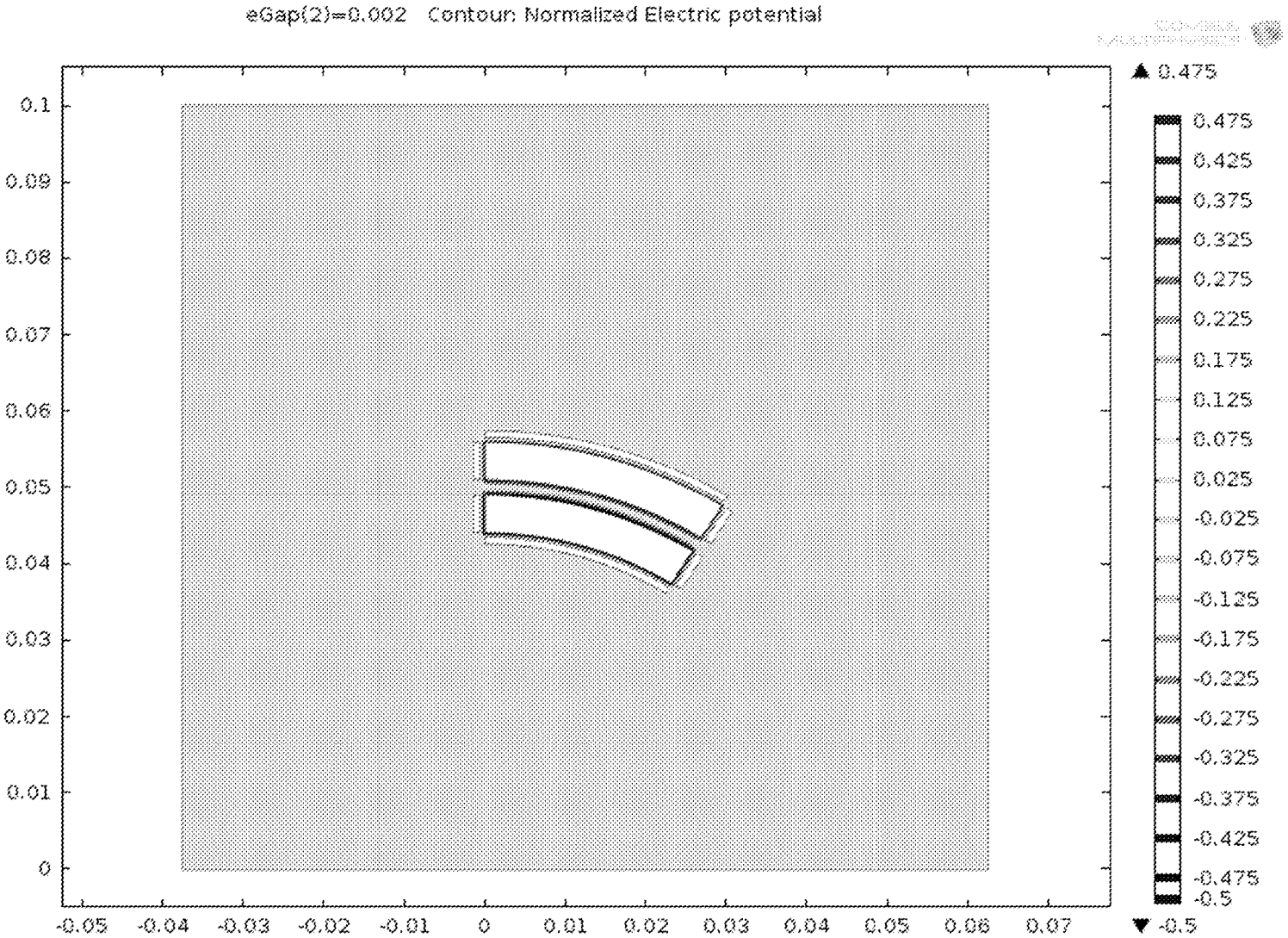
Figure 3:
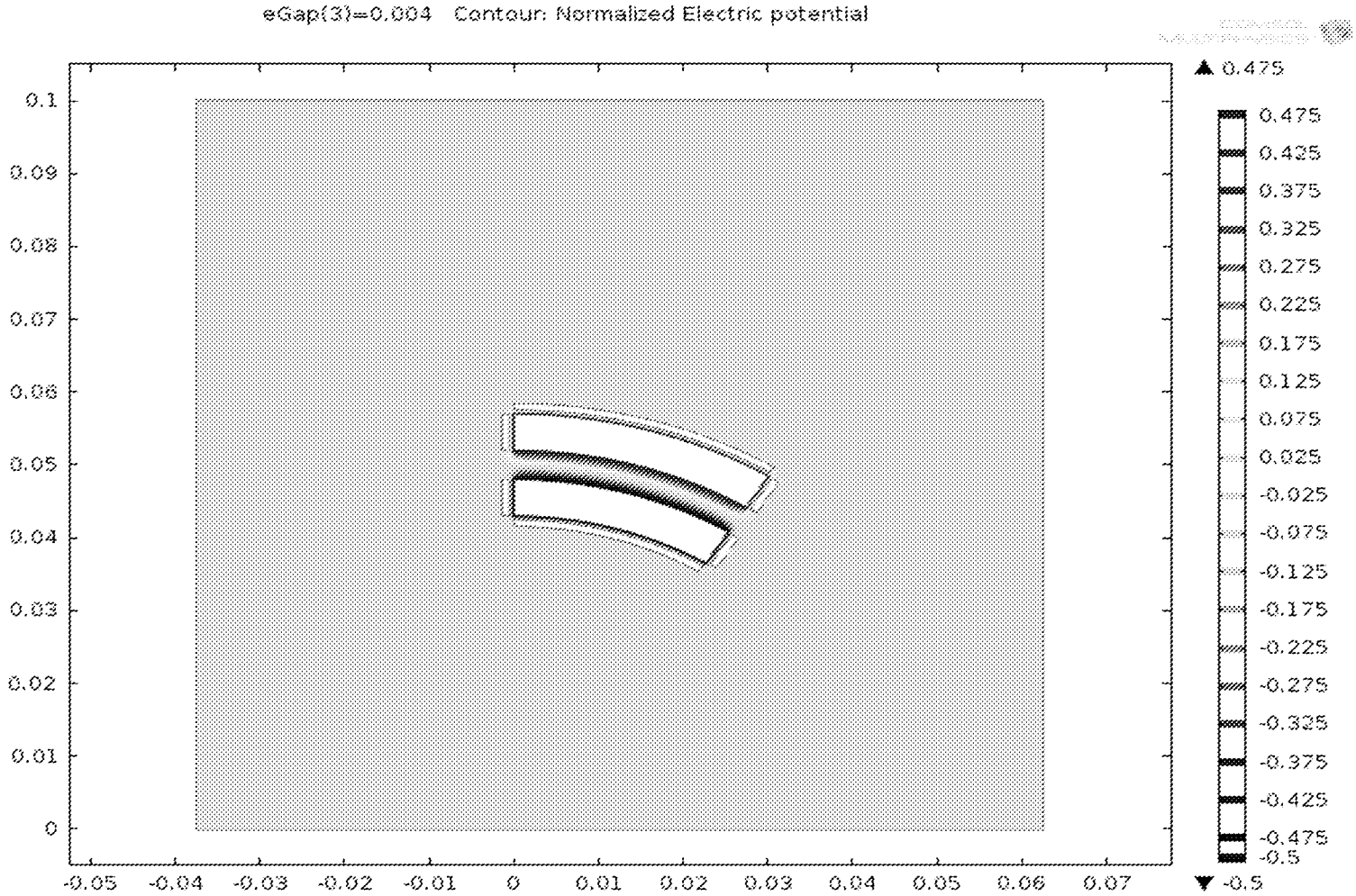
Figure 3:
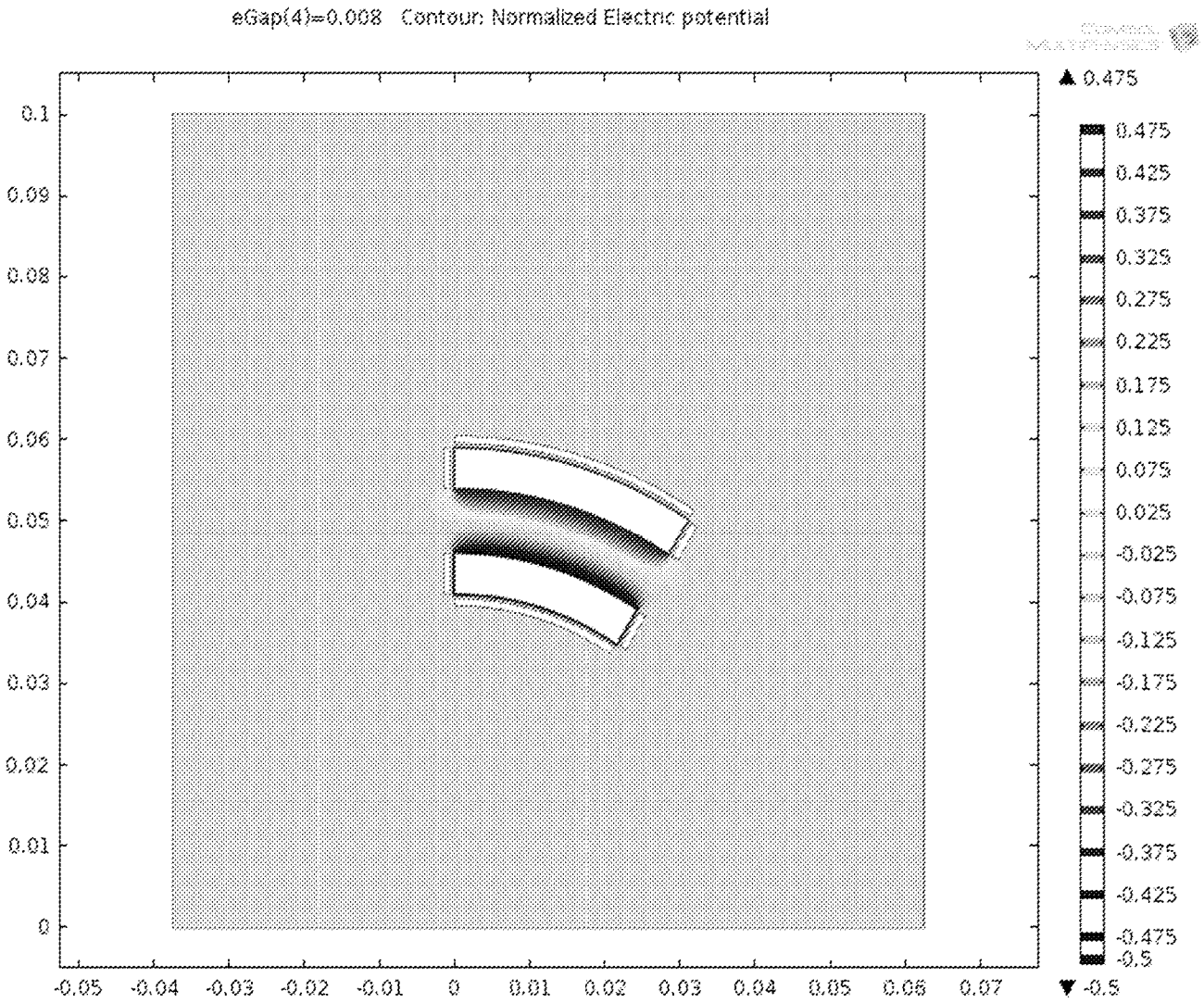
Figure 3:
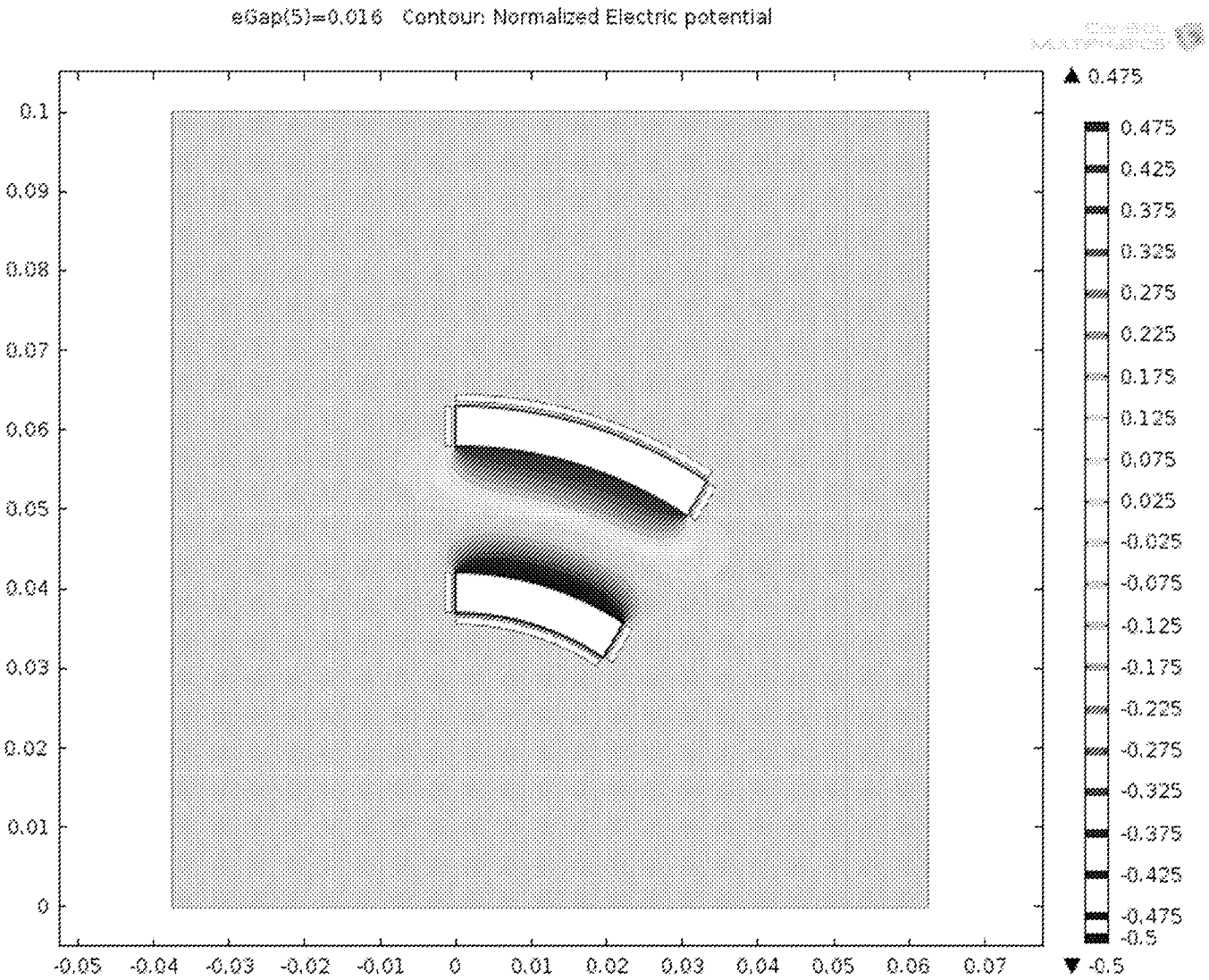
Figure 3:
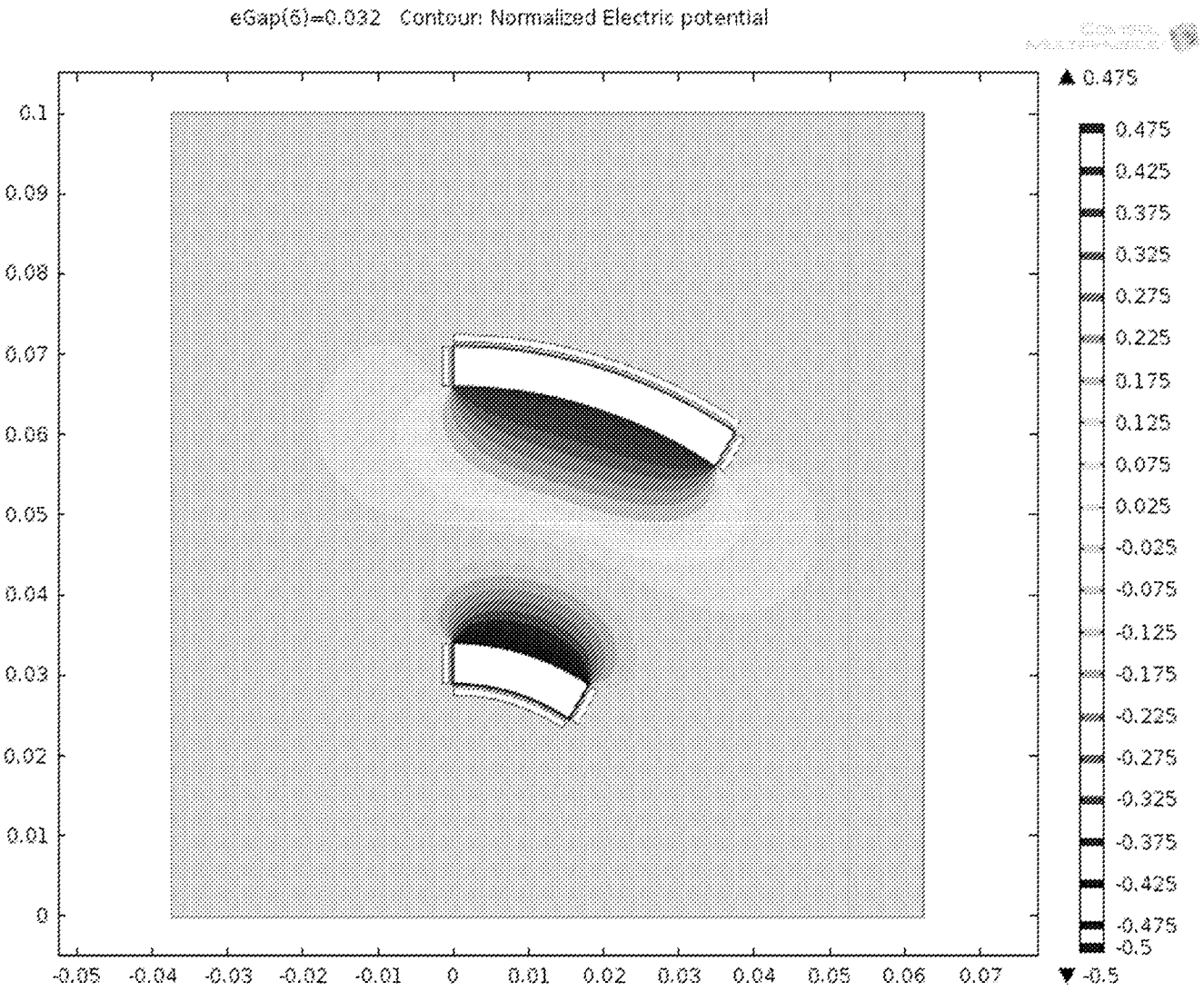

FIG. 3 illustrates field maps for conventional electric sectors with increasing gap widths of 1, 2, 4, 8, 16, and 32 mm. As the gap increases, the field becomes less uniform across the center as highlighted in the figure. The performance of the Herzog shunts to limit the fringing field aberrations also decreases with sector width, which is indicated by how far the electric field spills out from the edges of the wider gap sectors (such as the yellow region in the bottom right figure).

Figure 4:
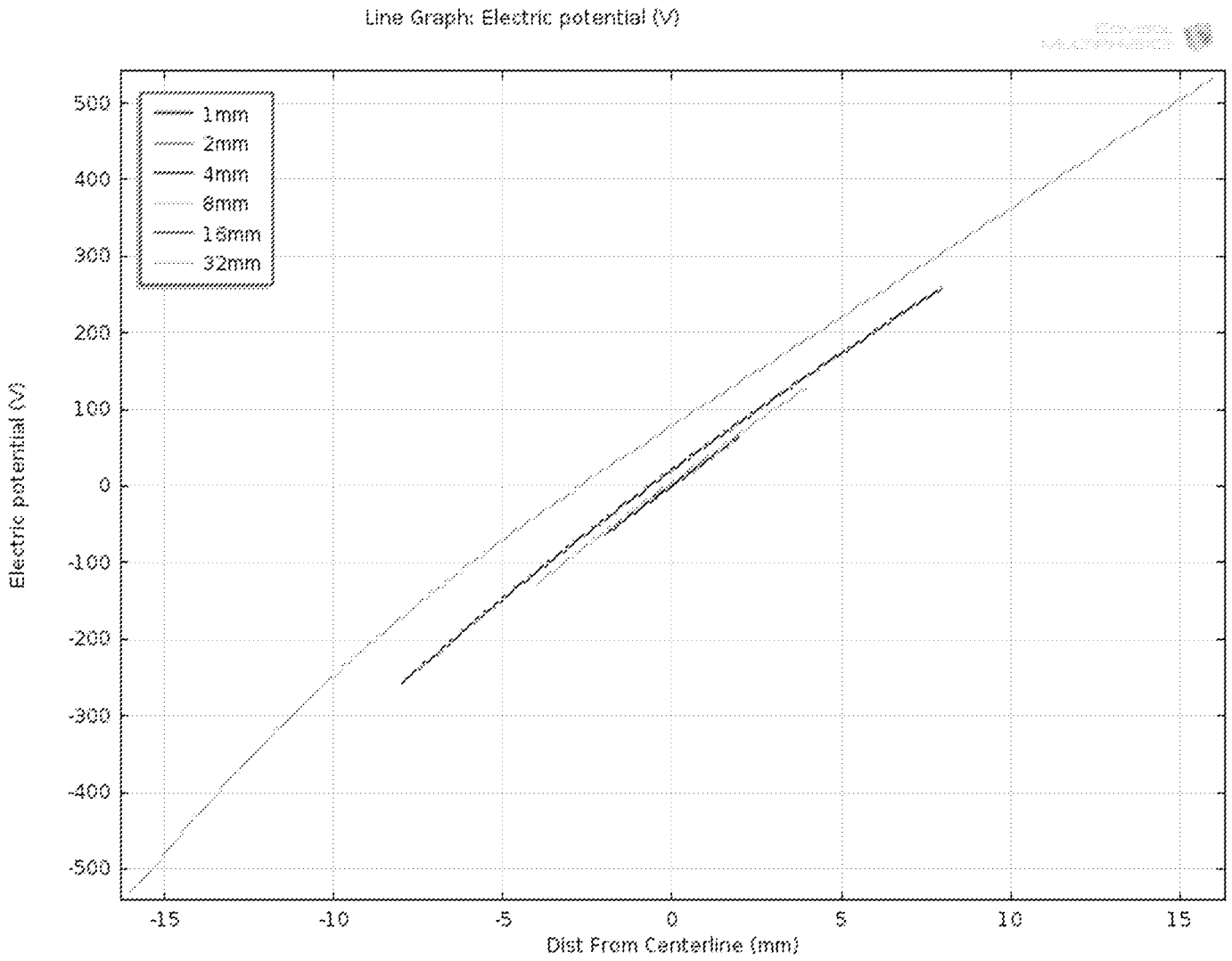
FIG. 4 are graphs showing line scans across the center of each of the electric sectors shown in FIG. 3.
Figure 4:
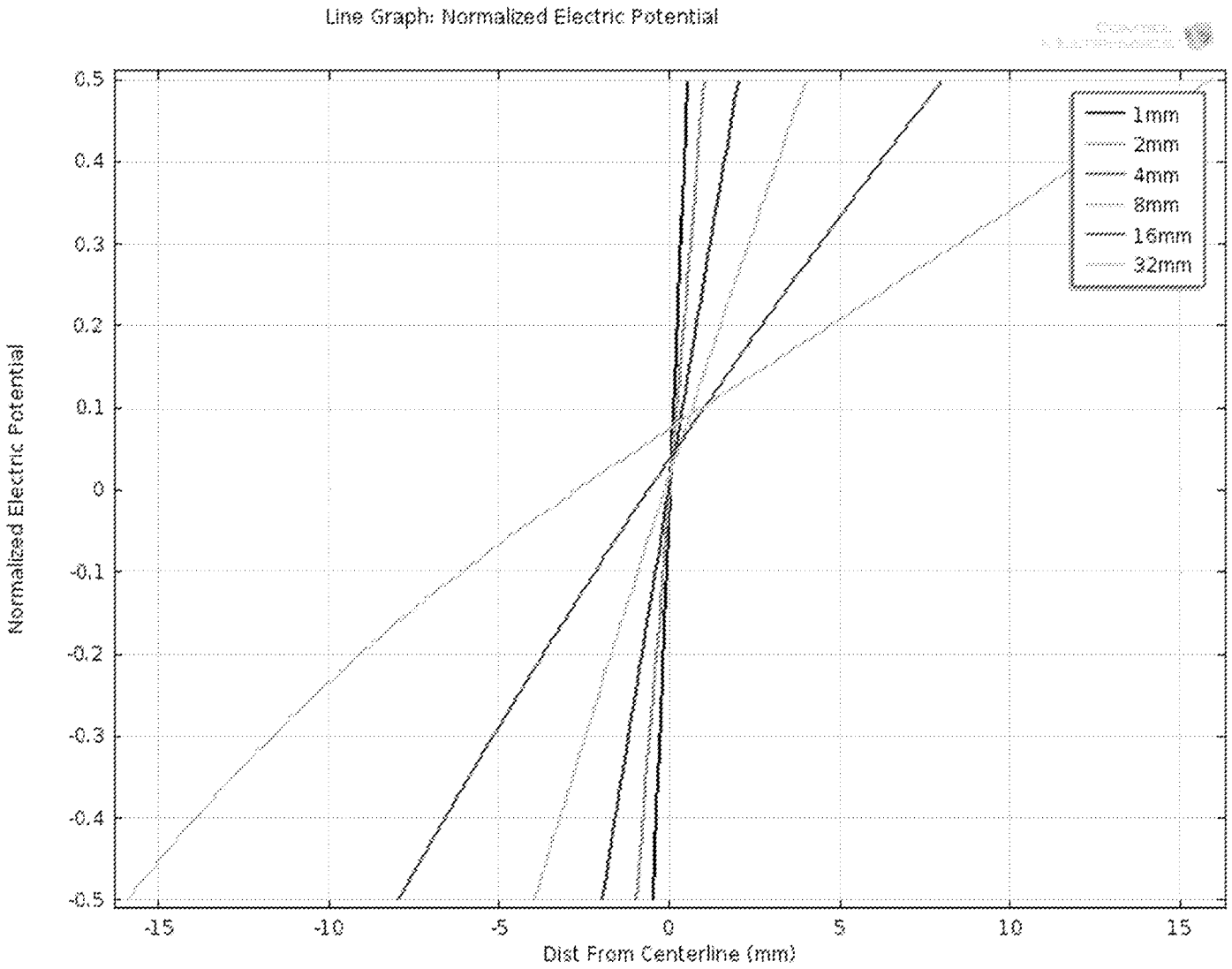

FIG. 4 illustrates graphs showing line scans across the center of each of the electric sectors shown in FIG. 3. The top plot shows that for increasing sector gaps, the electric field across the gap becomes more curved and offset from the original values. The bottom normalized plot shows this increase in curvature as the gap increases more clearly. This curvature indicates aberrations in the lens that can reduce performance metrics of mass resolution or pattern transfer. Note that these curves are for simulations of infinitely tall sectors, so performance of a finite height sector would be even worse.

Figure 5:
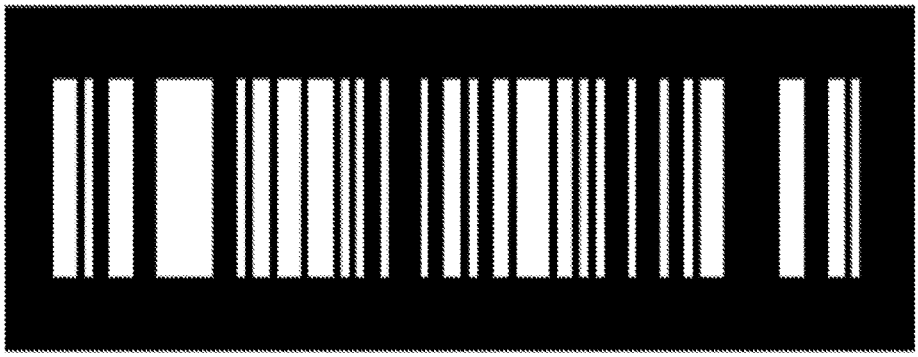
FIG. 5 depicts that when passing large encoded beams from higher order coded aperture patterns through a wide gap electric sector using conventional electrodes.
Figure 5:
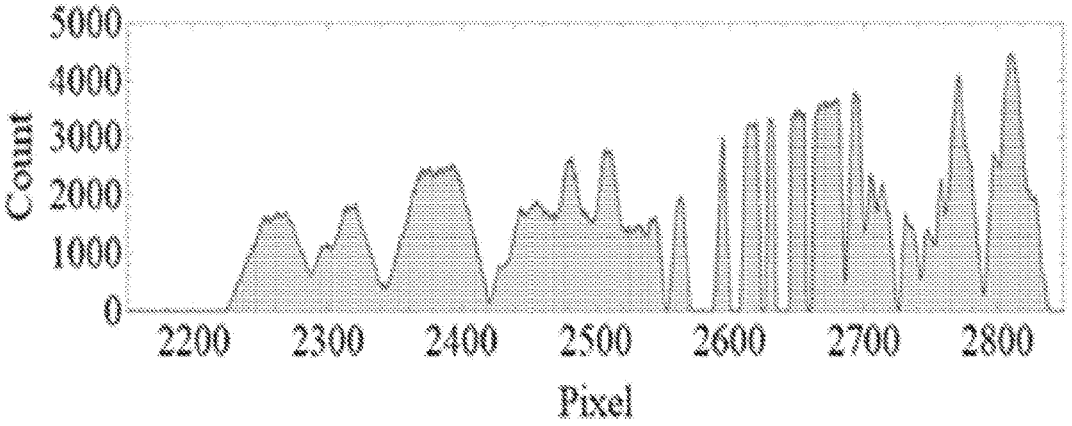
Figure 5:
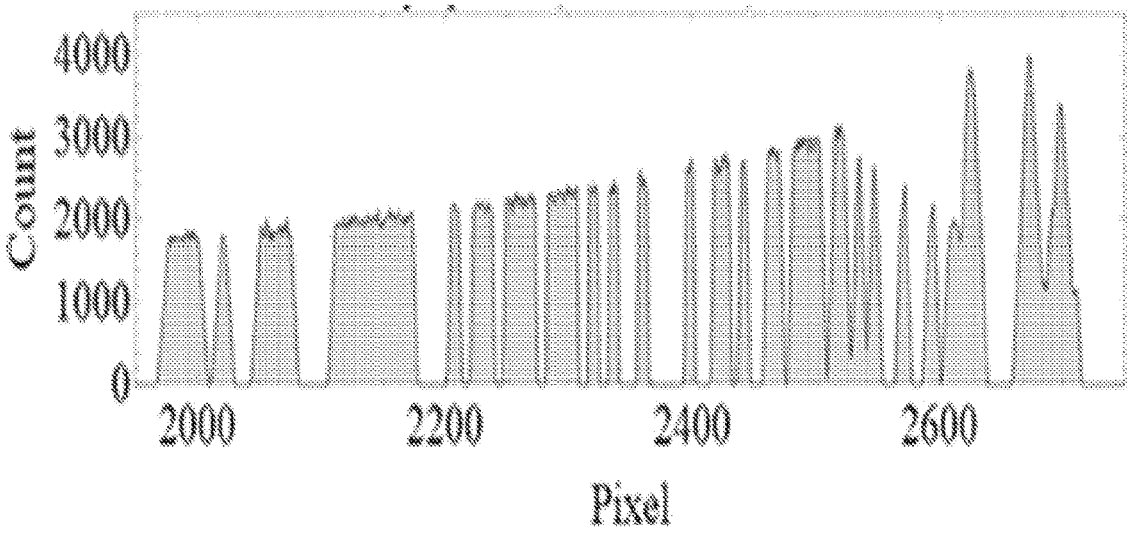

Referring to FIG. 5, this figure depicts that when passing large encoded beams from higher order coded aperture patterns (top picture) through a wide gap electric sector using conventional electrodes (Mattauch-Herzog style mass spectrograph), it can be seen that the aberrations of the wide gap and the fringing fields distort the pattern to an almost unrecognizable state (middle picture). Even through computational optimization of the electrodes positions and voltages, all the aberrations in the system can not be corrected using convention lenses (bottom picture).

In accordance with embodiments of the present disclosure, "caps" may be placed on the top and bottom of an electric sector of a mass spectrometer or mass spectrograph and includes segmented electrodes. The segmented electrodes may be patterned across the caps. Further, different potentials can be applied to each electrode segment to achieve new field profiles for correcting aberrations.

Figure 6:
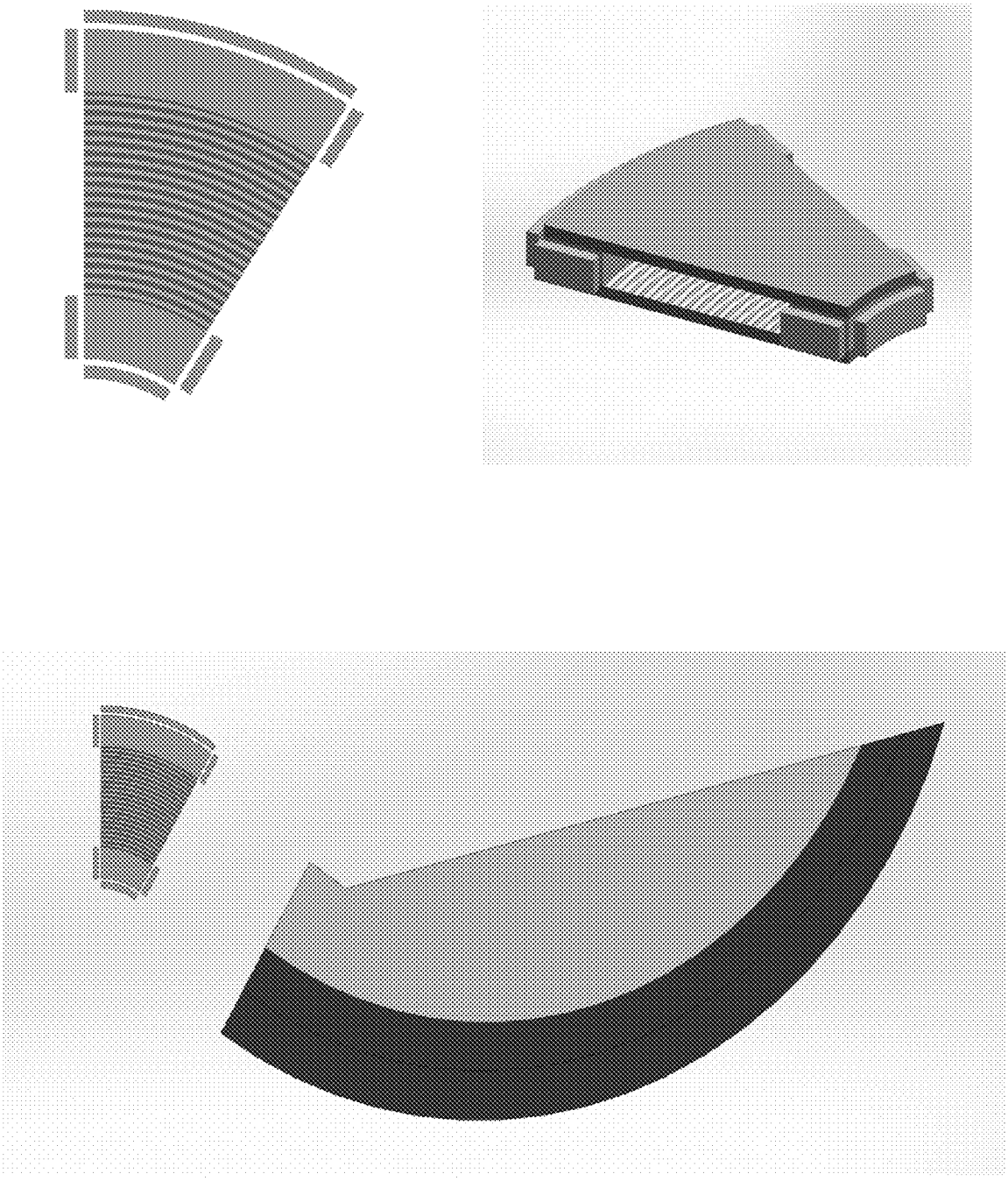
FIG. 6 illustrates schematic and CAD of a lens using segmented electrodes patterned onto top and bottom "caps" in accordance with embodiments of the present disclosure.

FIG. 6 illustrates schematic and CAD of a lens using segmented electrodes patterned onto top and bottom "caps" in accordance with embodiments of the present disclosure. Referring to FIG. 6, at the top left is a perspective view, and at the top right is an isometric perspective to illustrate the 3D structure of the lens. In both, the grey represents a conventional electrode components of the inner and outer electrodes, the Herzog shunts, and some shielding. The green represents a structural insulator. The gold represents segmented electrodes patterned onto or attached to the structural insulator. These segmented electrodes can be individually biased to form different electric field profiles. The bottom panel shows this type of electrode as it might be implemented with the popular Mattauch-Herzog style mass spectrograph geometry (brown is the magnet and black is the structural support and yoke of the magnet). These segmented electrodes can be used to correct for field aberrations in wide gap sectors. These lenses are also much lower profile than conventional electric sector lenses, which must be made very tall with respect to the gap width to maintain field uniformity. These sectors can be under 5 mm tall for a 20 mm gap, whereas conventional systems would need to be a minimum of 2× taller than the gap width with 10× being preferable.

Figure 7:
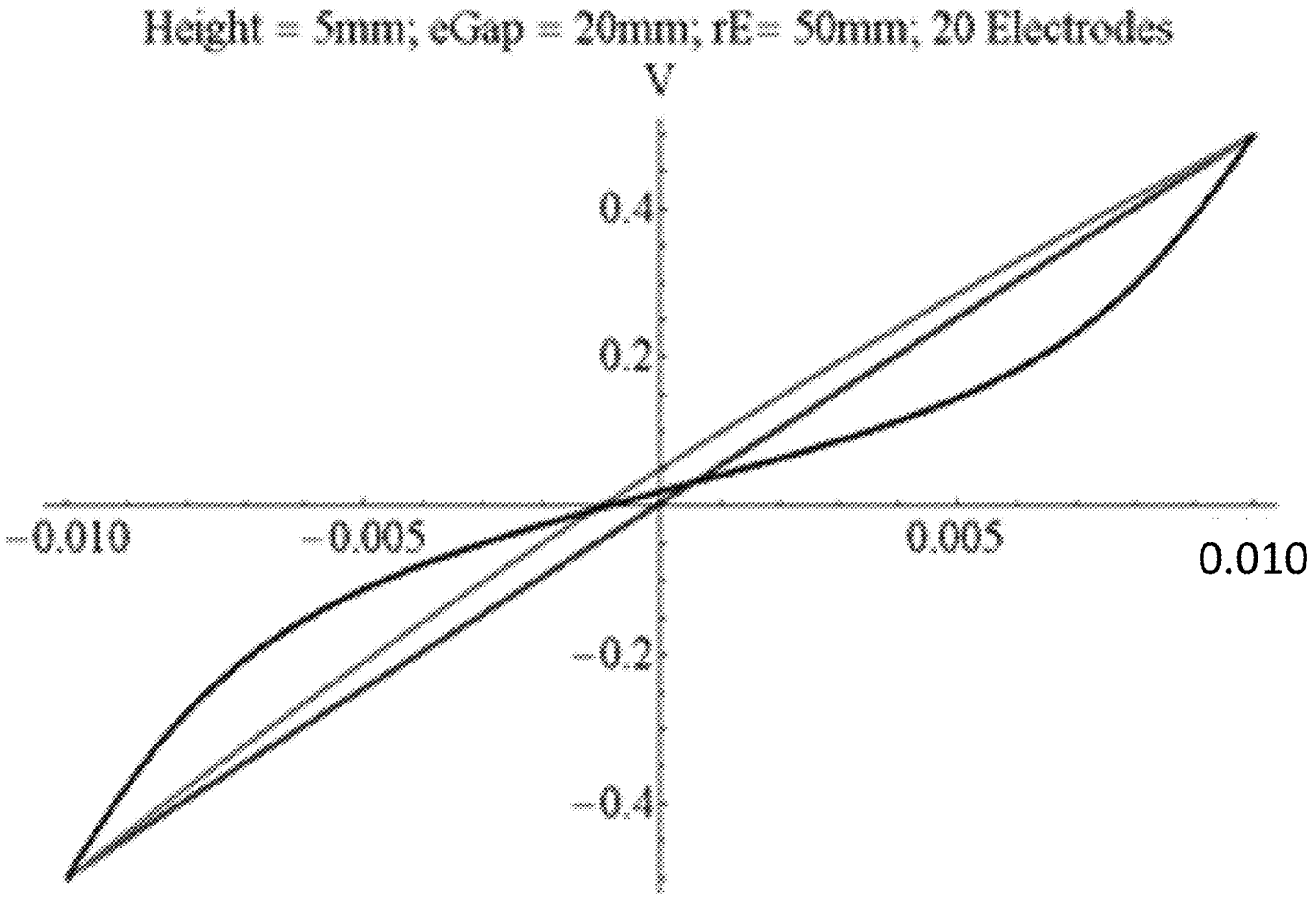
FIG. 7 illustrates a graph showing that a virtually arbitrary set of voltages can be applied to the segmented electrodes to produce different field profiles from those created from conventional lens systems.

FIG. 7 illustrates a graph showing that a virtually arbitrary set of voltages can be applied to the segmented electrodes to produce different field profiles from those created from conventional lens systems. Here in FIG. 7, it is shown that a conventional sector of infinite height and 20 mm gap in dashed black. When reducing the height of that sector down to the 5 mm height of our segmented electrodes, traditional sectors produce the highly aberrant blue curve. Segmented electrodes as described herein can be used to precisely recreate the performance of the infinite height sector, as shown by the black curve overlaying the green exactly. The segmented electrodes can also be used to produce entirely new field distributions, such as the "liner field" shown in red, which would be impossible to create using traditional electric sectors. Segmented electric sectors in accordance with embodiments of the present disclosure may be used for lenses.

Figure 8:
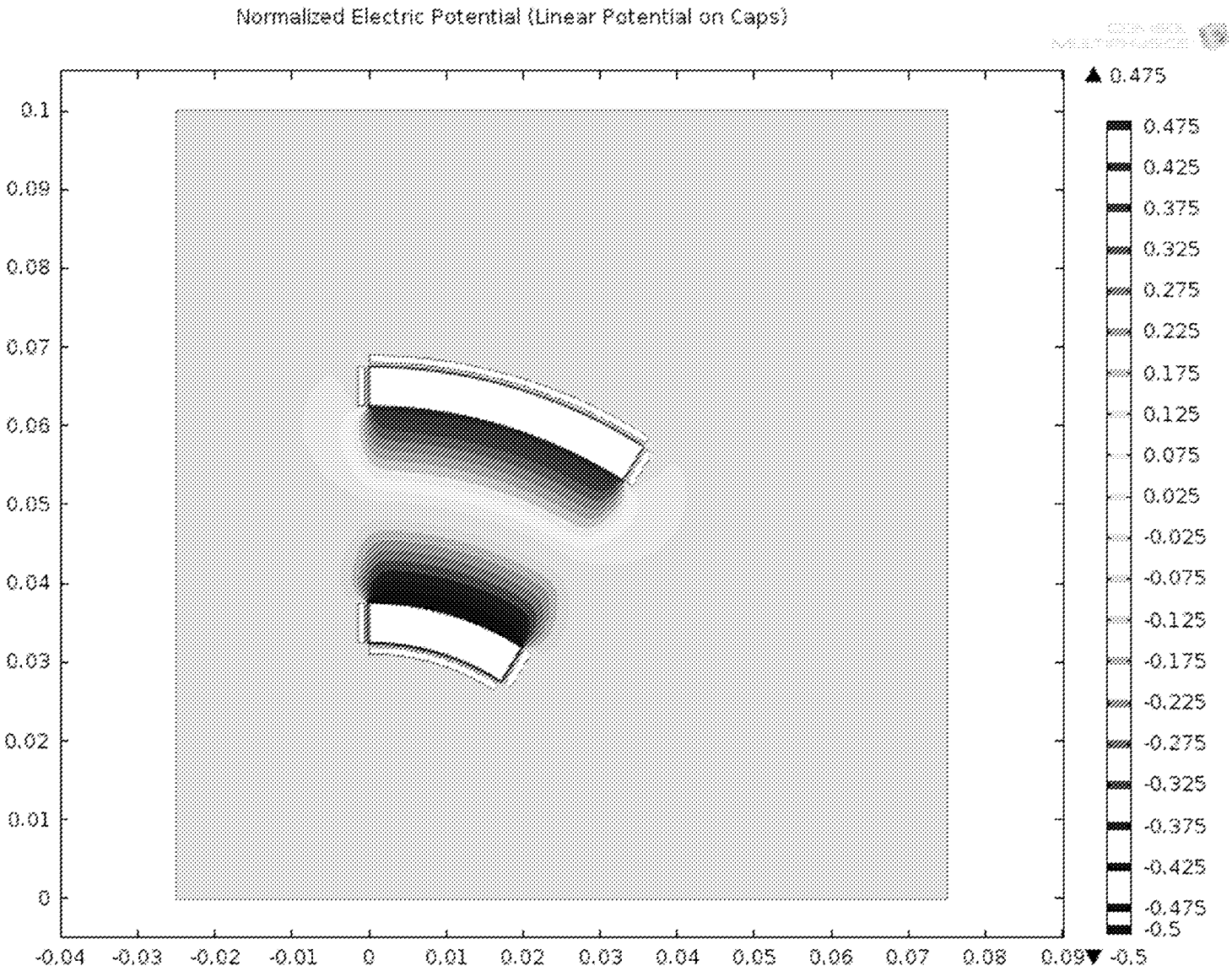
FIG. 8 shows at the top a field map for a segmented electrode electric sector, and at the bottom a CAD model of design implementation.
Figure 8:
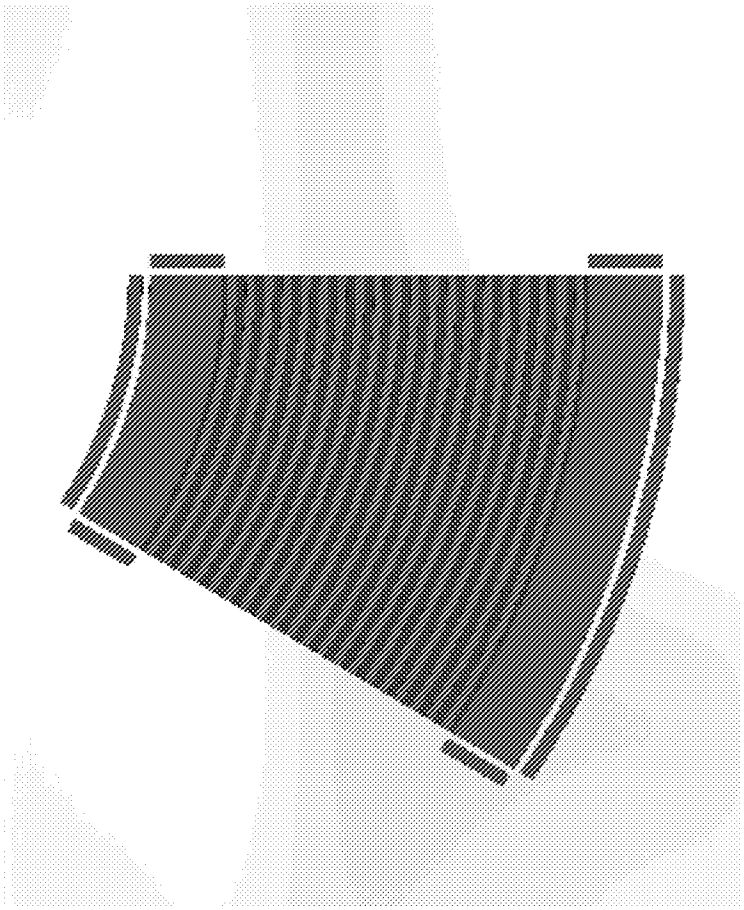

Using segmented electrodes to produce an electric field that varies linearly across the span of the sector, as shown in FIG. 7, large coded beams produced by higher order coded aperture patterns may be stigmated. FIG. 8 shows at the top a field map for a segmented electrode electric sector. At the bottom, FIG. 8 shows a CAD model of design implementation. The fringing fields are greatly reduced due to the segmented electrodes. These linear field sectors allow for large coded beams from higher order coded apertures to be passed through a double focusing mass spectrometer or mass spectrograph without distorting the coded pattern of the beam.

Figure 9:
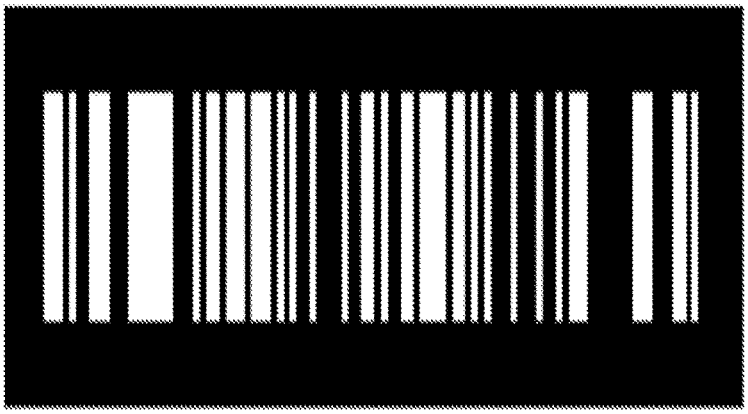
FIG. 9 illustrates an original coded aperature pattern and a 20 mm gap linear field segmented electrode electric sector pattern transfer.
Figure 9:
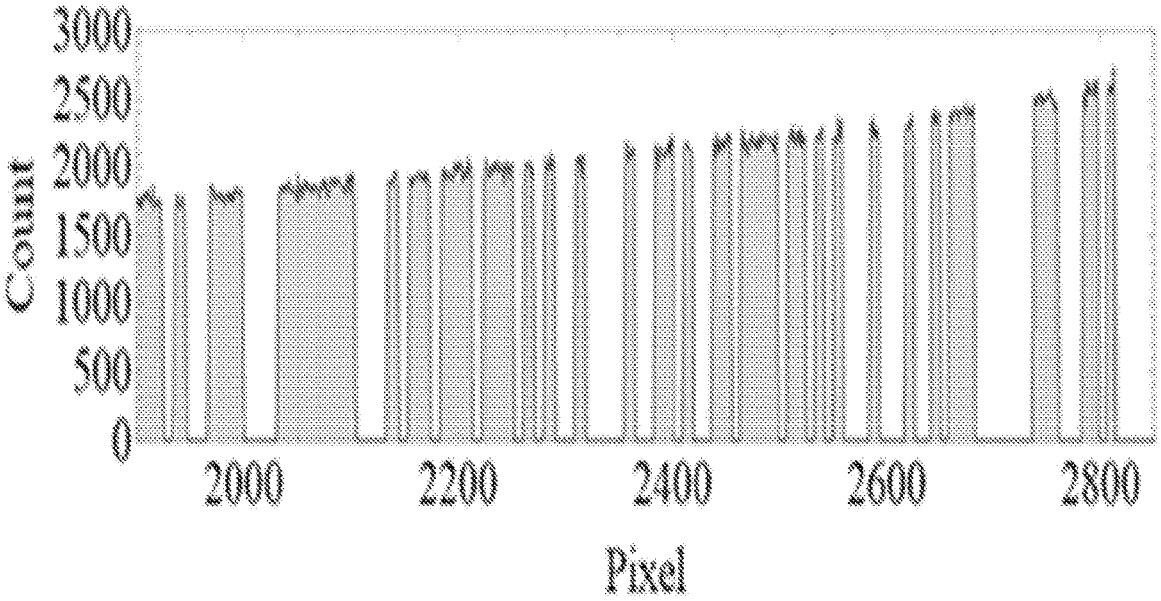

FIG. 9 illustrates an original coded aperature pattern and a 20 mm gap linear field segmented electrode electric sector pattern transfer. Referring to FIG. 9, when passing large encoded beams from higher order coded aperture patterns (top) through a wide gap electric sector using segmented electrodes with a linear field profile (Mattauch-Herzog style mass spectrograph), it can be seen that the pattern transfer is almost perfectly preserved, with only a slight magnification across its span, but little to no distortion. This is due to the improved lensing properties of this system and dramatically reduced fringing field effects, as shown in FIG. 8.

Figure 10:
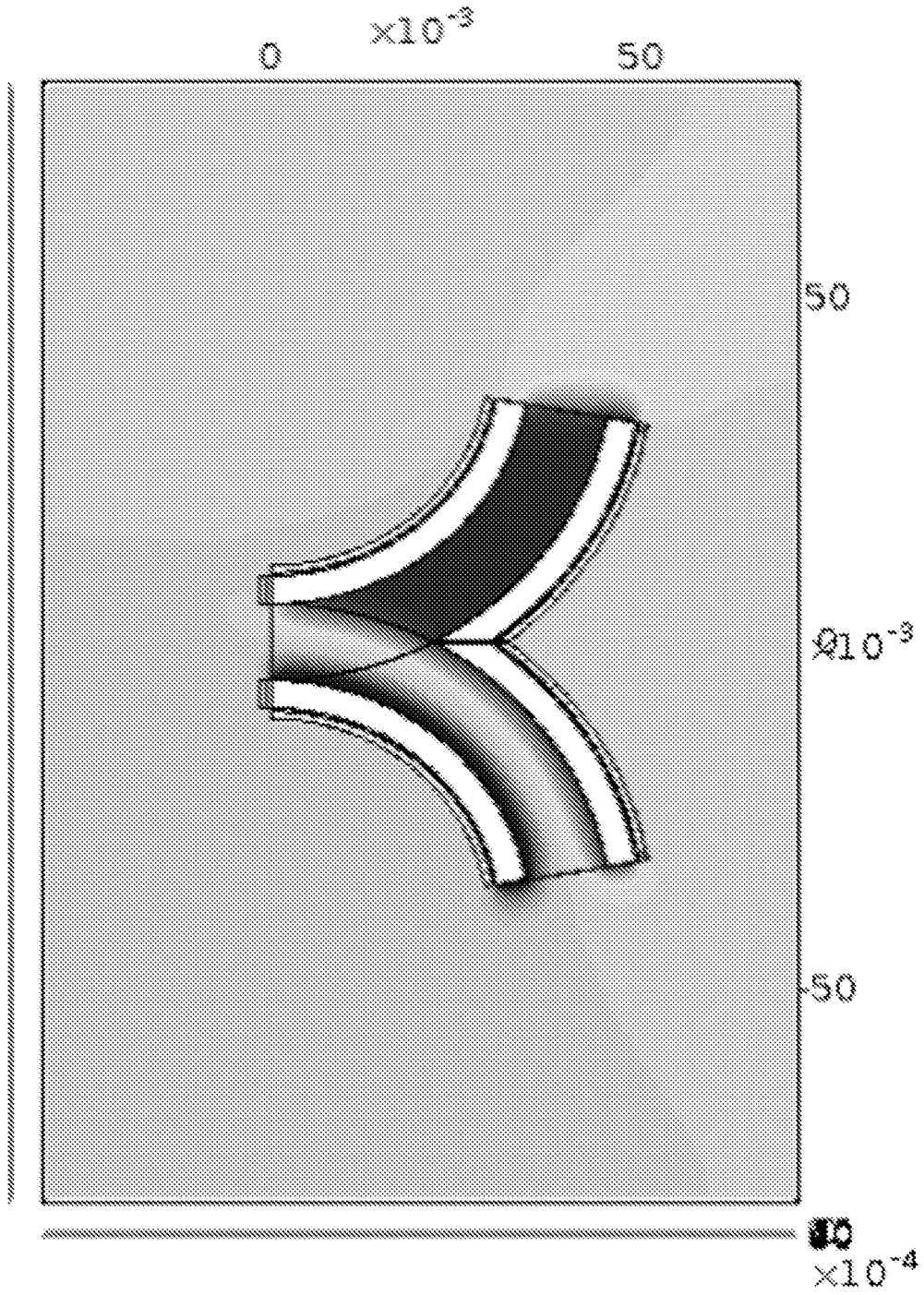
FIG. 10 shows sector fields in the top left and top right that demonstrate sector fields that can operate in two modes, and the bottom images show an example beam splitter in accordance with embodiments of the present disclosure.
Figure 10:
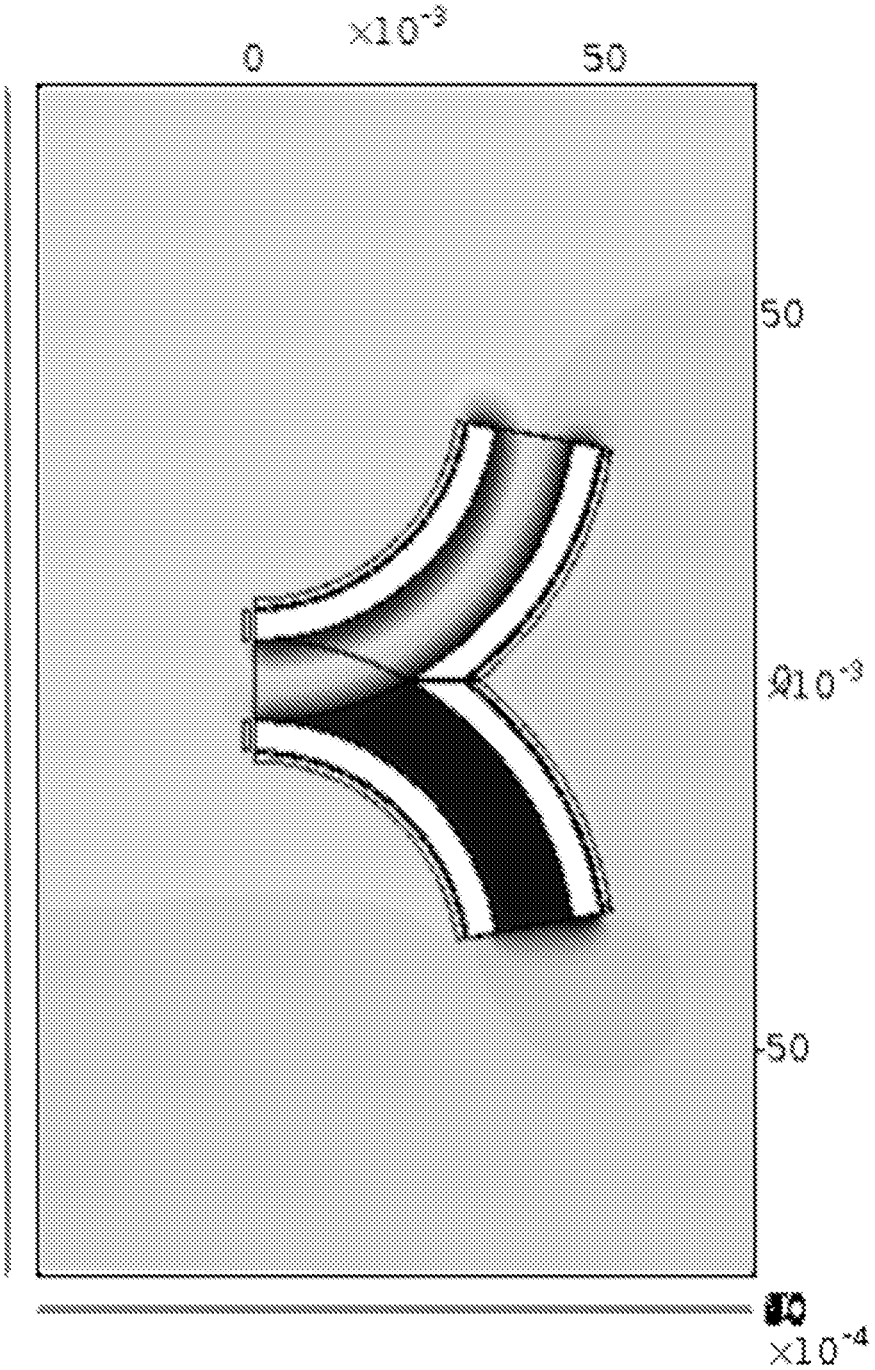
Figure 10:
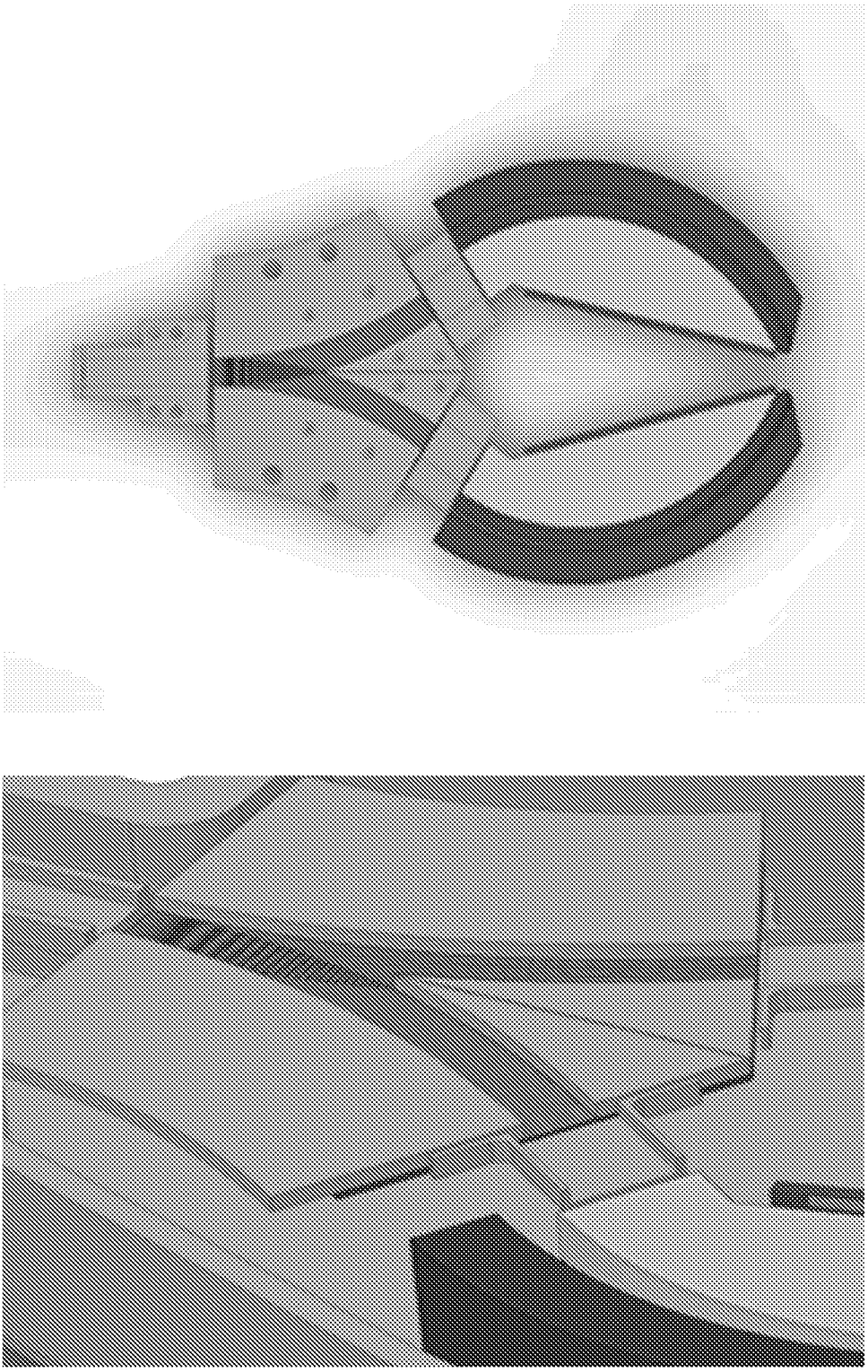

Using segmented electrodes in accordance with embodiments of the present disclosure, new lenses can be produced, such as a beam splitting electric sector. Such segmented electric sectors can not only allow large coded beams to pass through theses geometries, but also reduce the aberrations that would be seen by smaller or single beam systems they are incorporated into. Using the segmented electrodes, wide gap beam splitters can be provided that behave as if the branching path does not exist. FIG. 10 shows sector fields in the top left and top right that demonstrate sector fields that can operate in two modes, and the bottom images show an example beam splitter in accordance with embodiments of the present disclosure. One mode to turn positive ions one way, and another to send negative ions down another path. This design allows for dual polarity mass spectrometer designs to be constructed that do not sufferer from aberrations introduced from the beam splitting lens.

Figure 11:
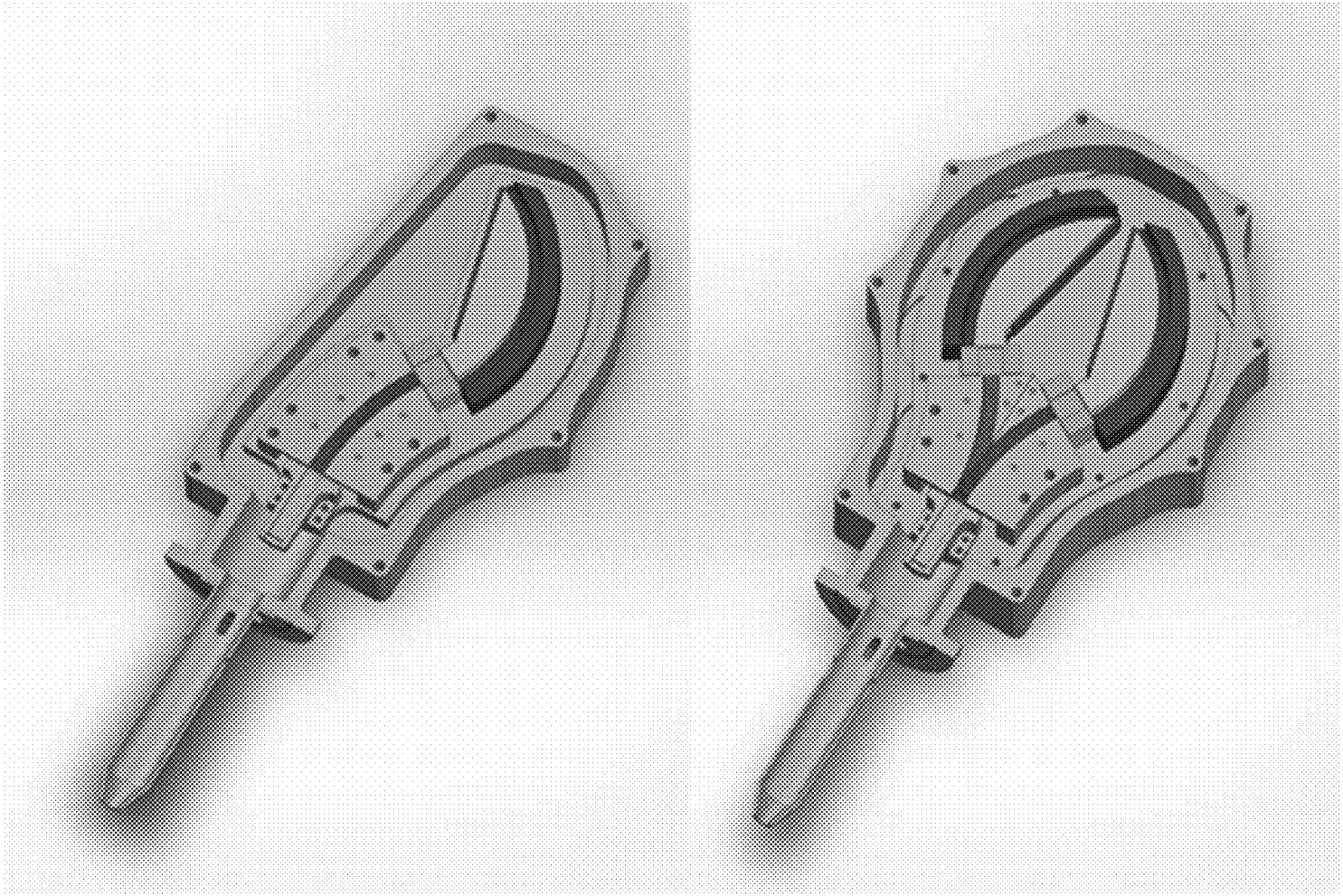
FIG. 11 illustrates single polarity (top) and dual polarity (bottom) FIB-SIMS instruments using coded aperture.

In accordance with embodiments of the present disclosure, lenses as described herein may be able to stigmate large coded beams from higher order coded aperture patterns. This lens design integrated into a double focusing Mattauch-Herzog style mass spectrometer provides excellent performance increases as demonstrated in FIG. 9. This design can be integrated into a Focused Ion Beam Secondary Ion Mass Spectrometer (FIB-SIMS). The use of coded apertures for FIB-SIMS can increase the collection angle and sensitivity of this instrument class and can reduce the size of the instrument by relaxing design constraints needed for good performance. If using a permanent magnet for smaller magnetic sectors in these systems, only one polarity of ions can be used for a single configuration normally. By also integrating our beam splitting electric sector, a dual polarity instrument is possible. Single and dual polarity FIB-SIMS instrument models are presented in FIG. 11, which illustrates single polarity (top) and dual polarity (bottom) FIB-SIMS instruments using coded aperture, and segmented electrode electric sectors are presented.

Figure 12:
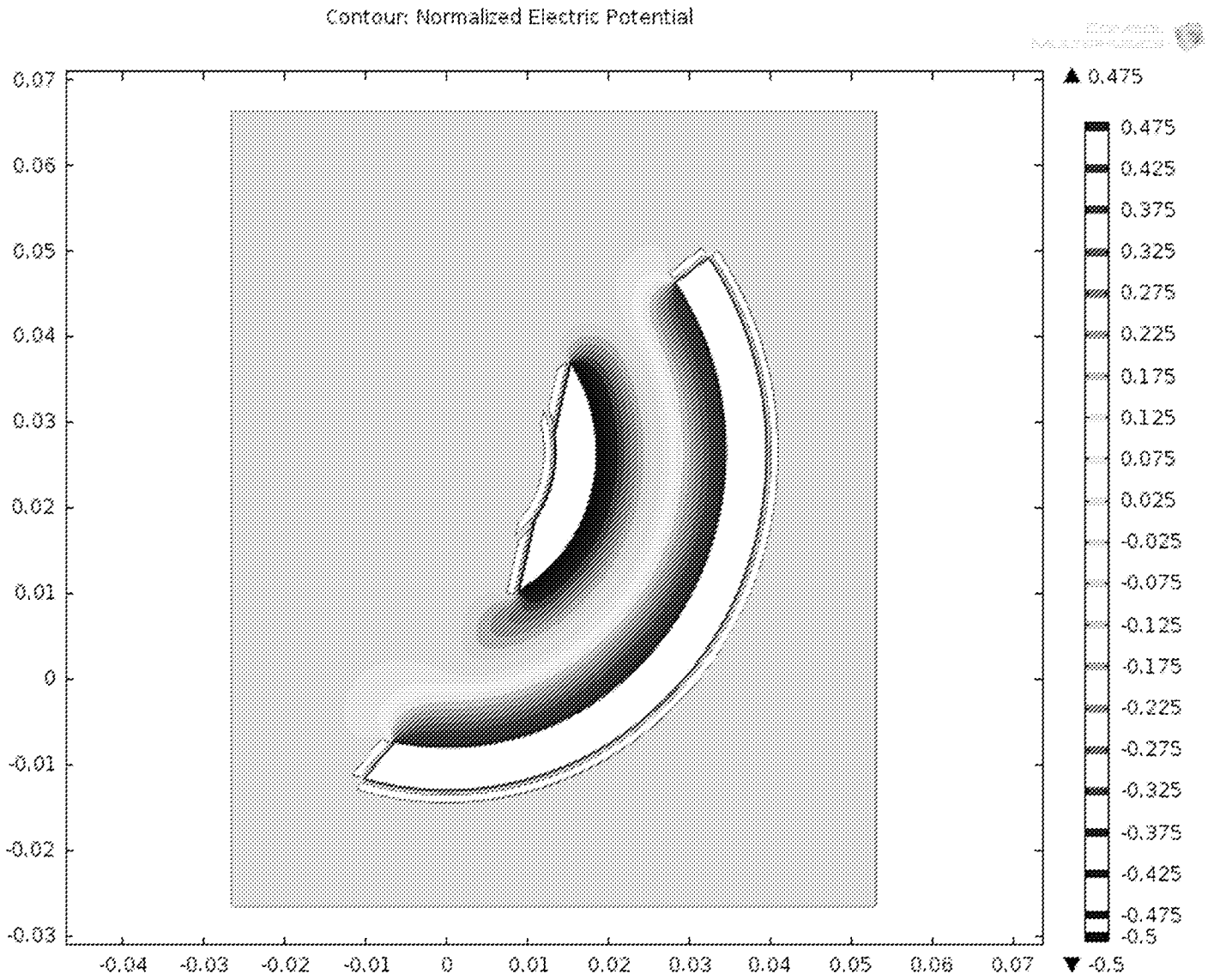
FIG. 12 depicts an electric field simulation at the top and a CAD model at the bottom.
Figure 12:
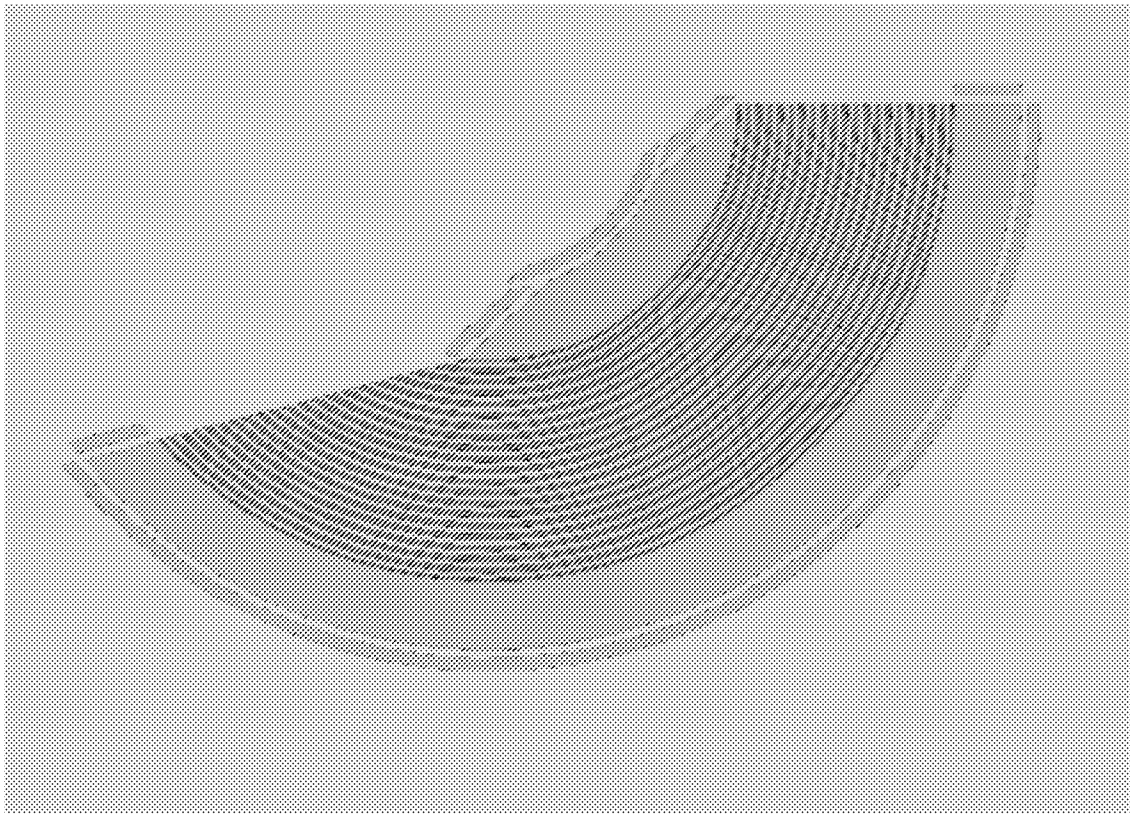

In accordance with embodiments of the present disclosure, the entrance and exit angles of electric sectors can be changed using the segmented electrode electric sectors. As an example, this may be used in magnetic sector design. Changing entrance and exit angles for electric sectors can have a dramatic impact on their lensing properties and can enable new classes of double focusing geometries to be discovered and built. Segmented electrodes can be used to change the entrance and exit face angles of electric sectors similar to what is done with magnetic sector lenses. FIG. 12 depicts an electric field simulation at the top and a CAD model at the bottom.

Figure 13:
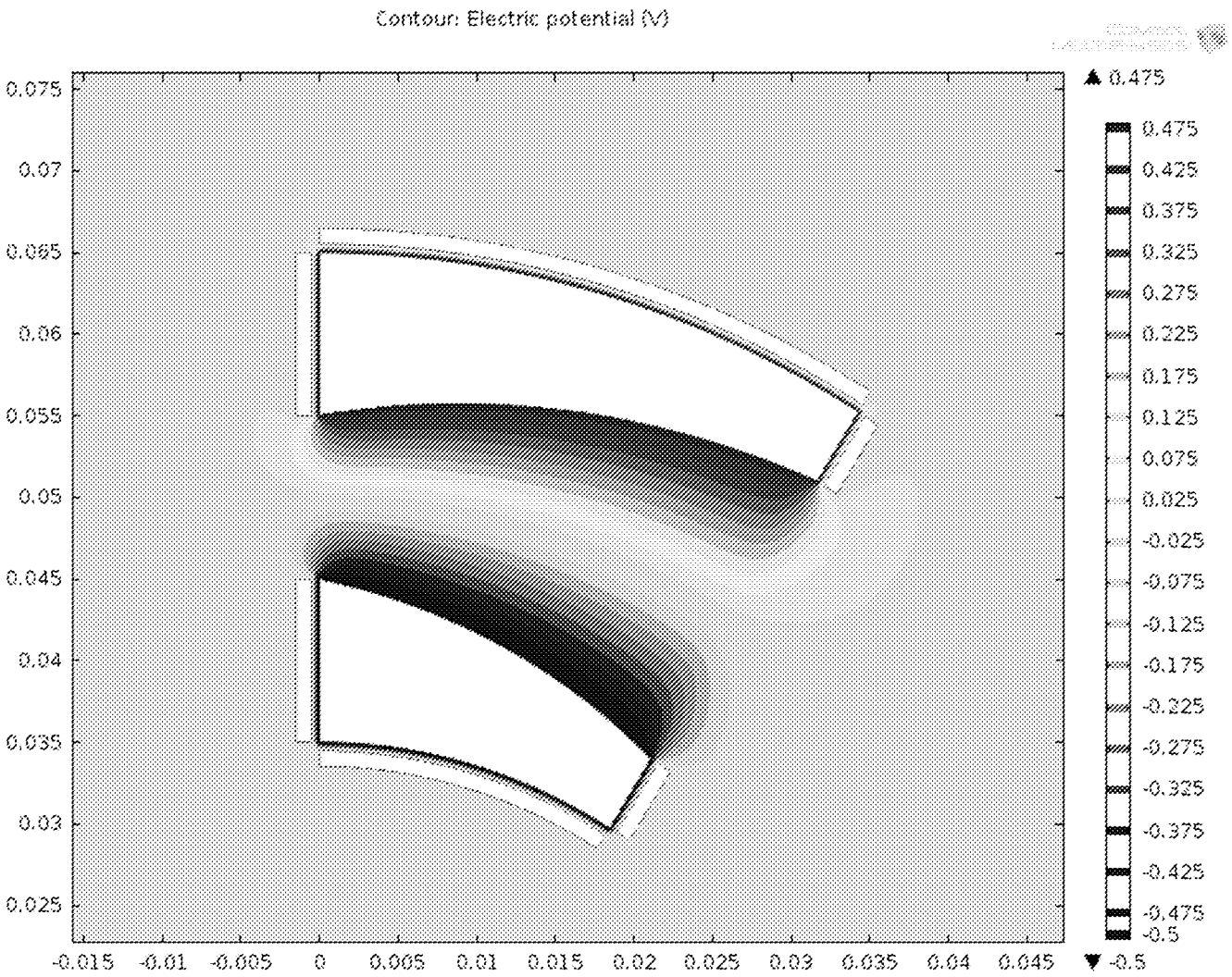
FIG. 13 illustrates an electric field simulation at the top and a CAD model to the right.
Figure 13:
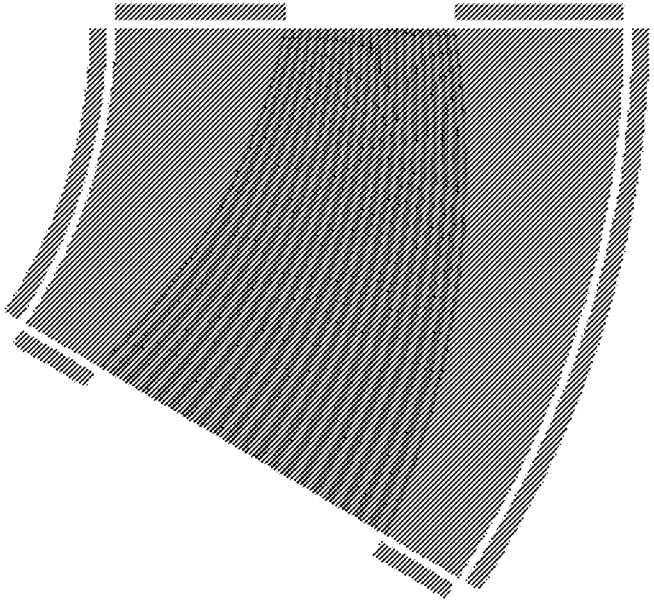

In accordance with embodiments of the present disclosure, electric sectors can be created with gaps that expand or contract across their length. These sectors can be used for beams or patterned beams that expand or condense greatly from the entrance to the exit of the electric sector. FIG. 13 illustrates an electric field simulation at the top and a CAD model to the right. This depicts how expanding and contracting sectors can also be fabricated using segmented electrodes.

Figure 14:
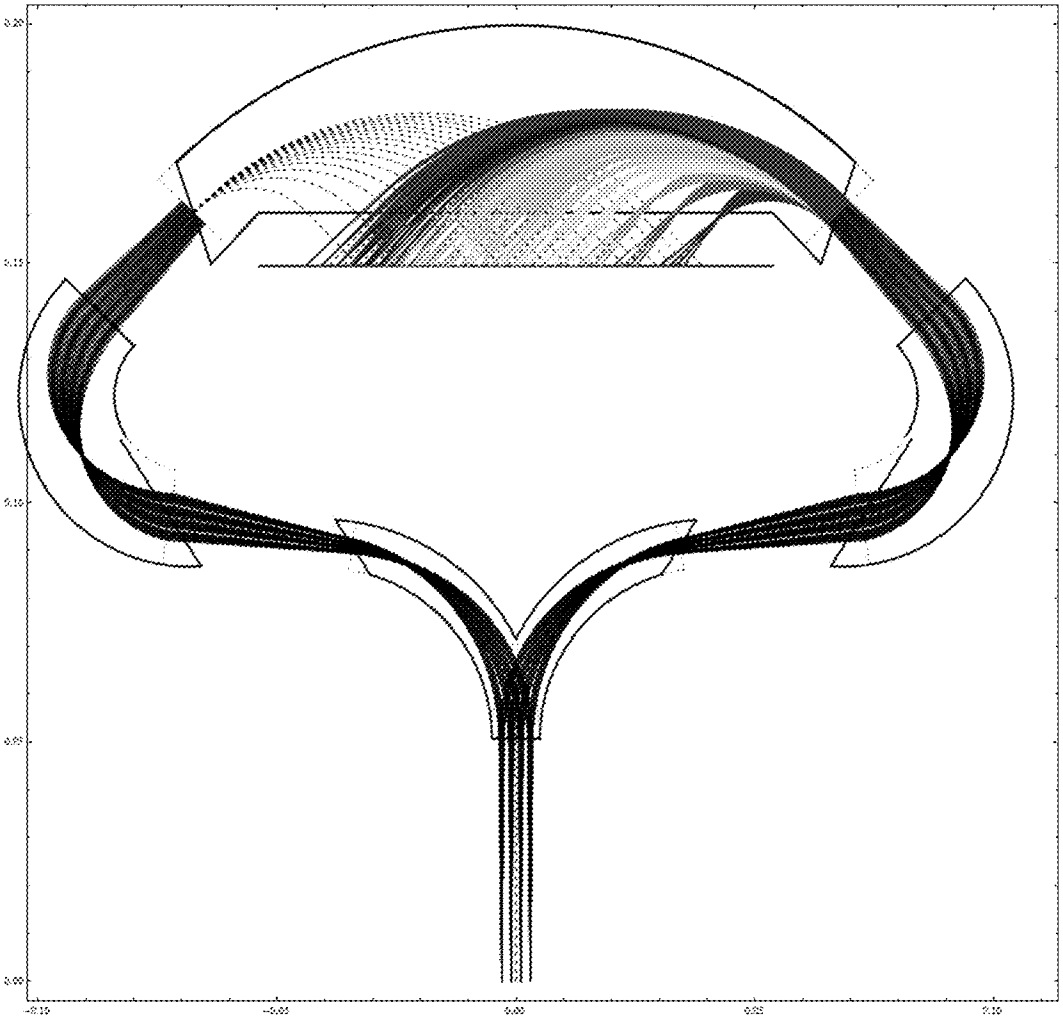
FIG. 14 illustrates a diagram of a dual polarity single detector double focusing mass spectrograph design using a segmented electrode beam splitter and tilted entrance and exit angle electric sectors in conjunction with a single permanent magnet.

In accordance with embodiments of the present disclosure, a double focusing mass spectrograph can be implemented. This mass spectrograph can perform snapshot analysis across the entire mass range for either positive or negative ions using permanent magnets (this means very low power consumption). Split sectors segmented electrodes, and tilted entrance and exit angle electric sectors can be used to produce this geometry. This configuration can be very useful if advanced ion imaging detectors are the cost limiting factor in instrument design, because the same detector is used for both positive and negative beam. FIG. 14 illustrates a diagram of a dual polarity single detector double focusing mass spectrograph design using a segmented electrode beam splitter and tilted entrance and exit angle electric sectors in conjunction with a single permanent magnet. This configuration is capable of large stigmated beams such as coded beams from coded apertures, or for other imaging mass spectrometry applications.

Electrodes as described herein may be individually controlled by a suitable controller, such as a computing device. For example, the electrodes may be electrically connected to the controller and the controller may selectively apply voltage across the electrodes.

In accordance with embodiments of the present disclosure, the apparatus described herein may be configured to separate particle beams of uniform mass to charge ratio, such as electron or proton beams) by energy rather than mass to charge ratio.

The various techniques described herein may be implemented with hardware or software or, where appropriate, with a combination of both. Thus, the methods and apparatus of the disclosed embodiments, or certain aspects or portions thereof, may take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for practicing the presently disclosed subject matter. In the case of program code execution on programmable computers, the computer will generally include a processor, a storage medium readable by the processor (including volatile and non-volatile memory and/or storage elements), at least one input device and at least one output device. One or more programs may be implemented in a high level procedural or object oriented programming language to communicate with a computer system. However, the program(s) can be implemented in assembly or machine language, if desired. In any case, the language may be a compiled or interpreted language, and combined with hardware implementations.

The described methods and apparatus may also be embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, a video recorder or the like, the machine becomes an apparatus for practicing the presently disclosed subject matter. When implemented on a general-purpose processor, the program code combines with the processor to provide a unique apparatus that operates to perform the processing of the presently disclosed subject matter.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

One skilled in the art will readily appreciate that the present subject matter is well adapted to carry out the objects and obtain the ends and advantages mentioned, as well as those inherent therein. The present examples along with the methods described herein are presently representative of various embodiments, are exemplary, and are not intended as limitations on the scope of the present subject matter. Changes therein and other uses will occur to those skilled in the art which are encompassed within the spirit of the present subject matter as defined by the scope of the claims.

What is claimed:

1. An apparatus comprising: an ion source configured to generate a spatially-extended distribution of ions from a sample; an electric sector configured with shunts and configured to disperse ions spatially based on their energy; a magnetic sector configured to disperse ions spatially based on their energy, the magnetic sector including a detector configured to detect a plurality of mass-to-charge ratios associated with the ions; a plurality of segmented electrodes positioned between the ion source and the detector, wherein the segmented electrodes are configured to provide a predetermined electric field profile in a gap of the electric sector; and a controller configured to selectively apply a predetermined voltage across at least two of the segmented electrodes for forming the predetermined electric field profile that focuses the ions on a focal plane of the detector according to the sample.

2. The apparatus of claim 1, wherein the apparatus comprises a mass spectrometer or mass spectrograph.

3. The apparatus of claim 1, wherein the segmented electrodes are substantially curved in the same direction.

4. The apparatus of claim 1, wherein the segmented electrodes reside in the electric sector of a mass spectrometer or mass spectrograph.

5. The apparatus of claim 1, further comprising insulators positioned between the segmented electrodes.

6. The apparatus of claim 1, wherein the controller is configured to apply the predetermined voltage across the segmented electrodes for correcting electric field aberrations.

7. The apparatus of claim 1, wherein the controller is configured to apply the predetermined voltage across the segmented electrodes for roughly linearly varying the predetermined electric field across the electric sector.

8. The apparatus of claim 1, wherein the segmented electrodes diverge such that the ions can be selectively passed along one of a plurality of pathways.

9. The apparatus of claim 1, wherein the apparatus is a focused ion beam secondary ion mass spectrometer.

10. The apparatus of claim 9, further comprising a permanent magnet.

11. The apparatus of claim 1, wherein the controller is configured to apply the predetermined voltage across the segmented electrodes in conjunction with curved entrance and exit pole faces of electric sectors.

12. The apparatus of claim 1, wherein the segmented electrodes are integrated in split electric sectors having a tilted entrance and tilted exit.

13. The apparatus of claim 1, wherein the segmented electrodes, the ion source, and the detector are implemented in one of an electron spectrometer and a mass spectrometer.

14. The apparatus of claim 1, wherein the particles analyzed have a uniform mass to charge ratio and are separated by energy.

* * * * *